US011827424B2

(12) United States Patent
Vachon

(10) Patent No.: US 11,827,424 B2
(45) Date of Patent: Nov. 28, 2023

(54) VENTED SPOUT FOR A LIQUID STORAGE CONTAINER

(71) Applicant: LE GROUPE DSD INC., Thetford Mines (CA)

(72) Inventor: Leandre Vachon, Thetford Mines (CA)

(73) Assignee: LE GROUPE DSD INC., Thetford Mines (CA)

( * ) Notice: Subject to any disclaimer, the term of this patent is extended or adjusted under 35 U.S.C. 154(b) by 105 days.

(21) Appl. No.: 17/389,854

(22) Filed: Jul. 30, 2021

(65) Prior Publication Data

US 2021/0354887 A1 Nov. 18, 2021

Related U.S. Application Data

(63) Continuation of application No. PCT/CA2019/051907, filed on Dec. 23, 2019.

(30) Foreign Application Priority Data

Feb. 1, 2019 (CA) ..... CA 3032442

(51) Int. Cl.
*B65D 47/06* (2006.01)

(52) U.S. Cl.
CPC ..... *B65D 47/06* (2013.01)

(58) Field of Classification Search
CPC ..... B65D 47/06; B65D 47/32; B65D 47/247; B65D 25/48; B67D 7/005
USPC ..... 222/559, 556–558; 141/535, 255, 246, 141/285, 292, 547, 335, 351, 366, 353, 141/198
See application file for complete search history.

(56) References Cited

U.S. PATENT DOCUMENTS 886,237 A 4/1908 Murtha
2,723,793 A 11/1955 Hubbell
2,822,832 A 2/1958 Craw
(Continued)

FOREIGN PATENT DOCUMENTS

CA 2545907 A1 11/2007
CA 2546129 A1 11/2007
(Continued)

OTHER PUBLICATIONS

Machine translation in English of CN203558842.
(Continued)

*Primary Examiner* — Lien M Ngo
(74) *Attorney, Agent, or Firm* — Lavery, de Billy, L.L.P.; Gwendoline Bruneau

(57) ABSTRACT

The spout can be used on a rigid or a nonrigid container. It includes a first member slidingly movable with reference to a second member so as to open and close a valve located at a front end of the spout. In use, the liquid flow can automatically be decreased and even stopped when the receptacle is full. The spout can include an annular outer gasket to create an airtight connection between the spout and the opening of the receptacle during pouring. This allows nonrigid containers to be emptied without collapsing. It also allows any airborne droplets and vapors present in the opening of the receptacle to be drawn into the container with the incoming air during pouring, thereby preventing or minimizing the presence of such droplets and vapors in the surrounding environment.

20 Claims, 15 Drawing Sheets

(56) References Cited

U.S. PATENT DOCUMENTS

| | | | | |
|---|---|---|---|---|
| 2,841,313 | A | 7/1958 | Beall, Jr. | |
| 3,074,444 | A | 1/1963 | Hawksford | |
| 3,434,513 | A | 3/1969 | O'Bannon | |
| 3,540,402 | A * | 11/1970 | Kocher | H01M 50/609 141/308 |
| 3,606,096 | A * | 9/1971 | Campbell | B67D 7/005 222/479 |
| 3,734,149 | A | 5/1973 | Hansel | |
| 3,834,594 | A | 9/1974 | Schiemann | |
| 3,967,660 | A | 7/1976 | Russell | |
| 3,987,943 | A | 10/1976 | Richmond, Jr. | |
| 3,994,323 | A | 11/1976 | Takahata et al. | |
| 4,053,002 | A | 10/1977 | Ludlow | |
| 4,129,236 | A | 12/1978 | Wrycraft et al. | |
| 4,213,488 | A | 7/1980 | Pyle | |
| 4,478,242 | A | 10/1984 | Bond | |
| 4,564,132 | A | 1/1986 | Loyd-Davies | |
| 4,667,710 | A * | 5/1987 | Wu | B67B 7/26 141/198 |
| 4,746,036 | A | 5/1988 | Messner | |
| 4,796,678 | A | 1/1989 | Motohashi et al. | |
| D303,634 | S | 9/1989 | Vachon | |
| 4,871,096 | A | 10/1989 | Horian | |
| 4,924,921 | A | 5/1990 | Simmel et al. | |
| 4,958,668 | A | 9/1990 | Vachon | |
| 1,982,881 | A | 1/1991 | Amrein | |
| 5,042,698 | A | 8/1991 | Fessell | |
| 5,076,333 | A * | 12/1991 | Law | B67D 3/046 141/335 |
| 5,092,497 | A | 3/1992 | Toedter | |
| 5,107,909 | A | 4/1992 | Donovan | |
| 5,228,487 | A | 7/1993 | Thiermann et al. | |
| 5,249,611 | A | 10/1993 | Law | |
| 5,255,713 | A | 10/1993 | Scholle et al. | |
| 5,327,945 | A | 7/1994 | Simpson et al. | |
| 5,406,994 | A | 4/1995 | Mitchell et al. | |
| 5,419,378 | A | 5/1995 | Law | |
| 5,450,884 | A | 9/1995 | Shih et al. | |
| 5,507,328 | A | 4/1996 | Donovan | |
| 5,560,522 | A | 10/1996 | Clark | |
| 5,603,364 | A | 2/1997 | Kerssies | |
| 5,628,352 | A | 5/1997 | Gracyalny et al. | |
| 5,711,355 | A | 1/1998 | Kowalczyk | |
| 5,762,117 | A | 6/1998 | Law | |
| 5,961,001 | A | 10/1999 | Davis et al. | |
| 5,988,458 | A | 11/1999 | Messner | |
| 6,155,464 | A | 12/2000 | Vachon | |
| 6,227,419 | B1 | 5/2001 | Raboin | |
| 6,401,752 | B1 | 6/2002 | Blackbourn et al. | |
| 6,435,380 | B1 | 8/2002 | Raboin | |
| 6,478,058 | B1 | 11/2002 | Pears | |
| 6,581,851 | B1 * | 6/2003 | Murphy | B67D 7/005 141/285 |
| 6,722,535 | B1 | 4/2004 | Flach | |
| 6,742,680 | B2 | 6/2004 | Friedman | |
| 6,889,732 | B2 | 5/2005 | Allen | |
| 6,968,875 | B2 | 11/2005 | Nielsen | |
| 7,013,936 | B2 * | 3/2006 | Schliemann | B67D 7/005 141/264 |
| 7,513,395 | B2 | 4/2009 | Labinski et al. | |
| 7,543,723 | B2 | 6/2009 | Wilford et al. | |
| 7,621,304 | B2 | 11/2009 | Nielsen | |
| 8,038,035 | B2 | 10/2011 | Forbis | |
| 8,113,239 | B2 | 2/2012 | Richards et al. | |
| 8,201,595 | B2 * | 6/2012 | Trippi, Jr. | B67D 7/005 141/366 |
| 8,403,185 | B2 | 3/2013 | Vachon | |
| 8,567,646 | B1 | 10/2013 | Cray | |
| 8,616,419 | B2 | 12/2013 | Slack | |
| 8,800,826 | B2 | 8/2014 | Forbis et al. | |
| 9,493,280 | B2 | 11/2016 | Wilkinson et al. | |
| 9,783,404 | B2 | 10/2017 | Van Gelder et al. | |
| 10,196,187 | B2 | 2/2019 | Hingorani | |
| 10,308,405 | B2 | 6/2019 | Gaikwad et al. | |
| 10,427,843 | B2 | 10/2019 | Julien et al. | |
| 10,472,137 | B2 | 11/2019 | Vachon | |
| 10,683,148 | B2 | 6/2020 | Adam et al. | |
| 2004/0025968 | A1 * | 2/2004 | Allen | B67D 7/005 141/351 |
| 2010/0078094 | A1 | 4/2010 | Trippi, Jr. | |
| 2012/0118431 | A1 | 5/2012 | Dickie | |
| 2014/0097210 | A1 | 4/2014 | Wright | |
| 2017/0327281 | A1 | 11/2017 | Cross | |
| 2018/0037379 | A1 * | 2/2018 | Adam | B67D 7/42 |
| 2019/0093823 | A1 | 3/2019 | Scott et al. | |

FOREIGN PATENT DOCUMENTS

| | | | |
|---|---|---|---|
| CN | 203558842 | U | 4/2014 |
| EP | 0112938 | A2 | 7/1984 |
| EP | 3067312 | B1 | 8/2017 |
| JP | 11070957 | A | 3/1999 |
| JP | 2005041541 | A | 2/2005 |
| WO | 2014137216 | | 9/2014 |
| WO | 2015052507 | A1 | 4/2015 |
| WO | 2019200469 | A1 | 10/2019 |
| WO | 2020124272 | A1 | 6/2020 |
| WO | 2020154792 | A1 | 8/2020 |

OTHER PUBLICATIONS

Machine translation in English of JP11070957.
Machine translation in English of JP2005041541.
Machine translation in English of EP3067312B1.
European Extended Search Report issued in parent EP Application No. 19912774.7 dated Feb. 3, 2022.

* cited by examiner

VENTED SPOUT FOR A LIQUID STORAGE CONTAINER

CROSS REFERENCE TO PRIOR APPLICATIONS

The present case is a continuation of PCT Application No. PCT/CA2019/051907 filed 23 Dec. 2019. PCT/CA2019/051907 claims the benefits of Canadian patent application No. 3,032,442 filed 1 Feb. 2019. The entire contents of these prior patent applications are hereby incorporated by reference.

TECHNICAL FIELD

The technical field relates generally to vented spouts for liquid-storage containers.

BACKGROUND

Many different kinds of spouts have been proposed over the years for use during a gravity transfer of liquids from a container into a receptacle, such receptacle being for instance another container, a reservoir or a tank, to name just a few. Some of these spouts include an air vent to admit air inside the container when the liquid flows, and also a shutoff valve to control the liquid flow during the transfer. Examples can be found, for instance, in U.S. Pat. Nos. 8,403,185 and 8,561,858.

While most of the prior arrangements have been generally useful and convenient on different aspects, there are still some limitations and challenges remaining in this technical area for which further improvements would be highly desirable.

SUMMARY

In one aspect, there is provided a vented pouring spout for a liquid-storage container, the spout including: a first member including an elongated and generally tubular first main body having at least two longitudinally extending internal passageways, one being an air duct through which an air circuit passes when air enters the container and the other being a liquid duct through which a liquid circuit passes when the liquid flows out of the container, the air duct being generally positioned along a top side of the first main body and being smaller in cross section than that of the liquid duct, the air duct being segregated from the liquid duct; a valve having a valve member provided at a front end of the first member, the valve member including an outer circumferential groove in which is positioned a valve gasket; a second member including an elongated second main body inside which the first main body is slidingly axially movable, the second main body having a front section and a rear section, the front section having a front open end defining a valve seat that is engaged by the valve gasket when the spout is in a normally closed position to interrupt the air circuit and the liquid circuit, the valve gasket being out of engagement with the valve seat when the spout is in a fully opened position, the valve member having an outer periphery that is smaller than an inner periphery of the valve seat, whereby the valve gasket holds the first and second members together when positioned in the outer circumferential groove and, when removed from the outer circumferential groove, allows the first member to be pulled out from the second member; and a biasing element positioned between the first member and the second member to urge the spout towards the normally closed position.

There is also provided a vented pouring spout for a liquid-storage container, the spout including: a first member including an elongated and generally tubular first main body having at least two longitudinally extending internal passageways, one being an air duct through which an air circuit passes when air enters the container and the other being a liquid duct through which a liquid circuit passes when the liquid flows out of the container, the air duct being generally positioned along a top side of the first main body and being smaller in cross section than that of the liquid duct, the air duct being segregated from the liquid duct; a valve having a valve member provided at a front end of the first member; a second member including an elongated second main body inside which the first main body is slidingly axially movable, the second main body having a front section and a rear section, the front section having a front open end defining a valve seat that is engaged by the valve when the spout is in a normally closed position to interrupt the air circuit and the liquid circuit, the valve being out of engagement with the valve seat when the spout is in a fully opened position; and a biasing element positioned between the first member and the second member to urge the spout towards the normally closed position.

Details on the different aspects of the proposed concept will be apparent from the following detailed description and the appended figures.

DETAILED DESCRIPTION

Figure 1:
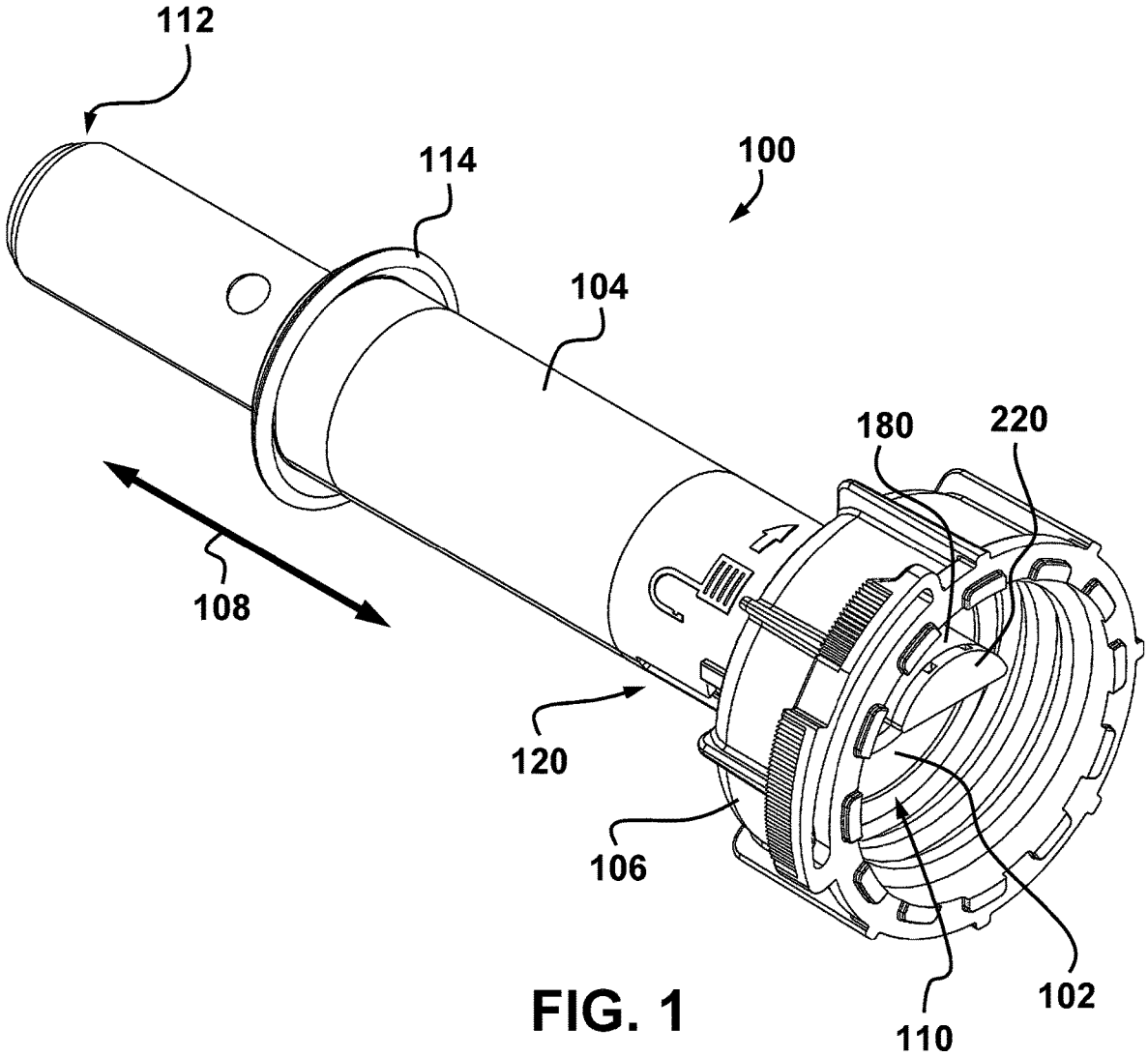
FIG. 1 is a rear isometric view of an example of a spout as improved.

FIG. 1 is a rear isometric view of an example of a spout 100 as improved. This spout 100 includes a first member 102 and a second member 104. The first member 102 can be longer than the second member 104, as shown in the illustrated example. This first member 102, however, is only partially visible in FIG. 1 since it is located inside the second member 104. The first and second members 102, 104 can be made of a plastic material, for instance using an injection molding process. Other materials, manufacturing processes, configurations and arrangements are also possible.

The illustrated spout 100 is shown with a threaded annular collar 106. This collar 106 can be used to removably attach the spout 100 to a container. Other configurations and arrangements are possible. Among other things, the collar 106 can be a part already present on a container. The spout 100 can be manufactured and sold without the collar 106. At least some of the other parts can also be designed differently or be omitted. Other variants are possible as well.

The first and second members 102, 104 can be substantially rectilinear conduits extending along a longitudinal axis 108, as shown in the illustrated example. This overall arrangement was found to be optimal for many implementations, such as for pouring liquid products from relatively small containers. It can also minimize manufacturing costs. Nevertheless, other configurations and arrangements are possible. Among other things, the first member 102 or the second member 104, or even both, can have a different shape. Still, although the first and second members 102, 104 as well as other parts of the illustrated spout 100 are generally circular in cross-section, both internally and externally, using noncircular shapes remains possible in some implementations. The present description refers to the diameters of some of the parts only for the sake of simplicity and not because they necessarily must have a circular cross-section. At least some of the other parts can also be designed differently or be omitted. Other variants are possible as well.

The spout 100 generally extends between a base 110 and a tip 112. The spout base 110 is the general area at the rear end of the spout 100 where liquid enters and where air exits during pouring. The spout tip 112 is the general area at the front end of the spout 100 where liquid exits and where air enters.

The spout 100 includes a built-in shutoff valve system located at the spout tip 112. The spout 100 can also include a locking arrangement, as shown in the illustrated example. This locking arrangement can be useful to keep the spout 100 in a locked position and prevent the valve system from being opened unless a specific operation is performed to unlock the spout 100. Other configurations and arrangements are possible. Among other things, at least some of the parts thereof can be designed differently or be omitted. The locking arrangement can be entirely omitted in some implementations. Other variants are possible as well.

Figure 2:
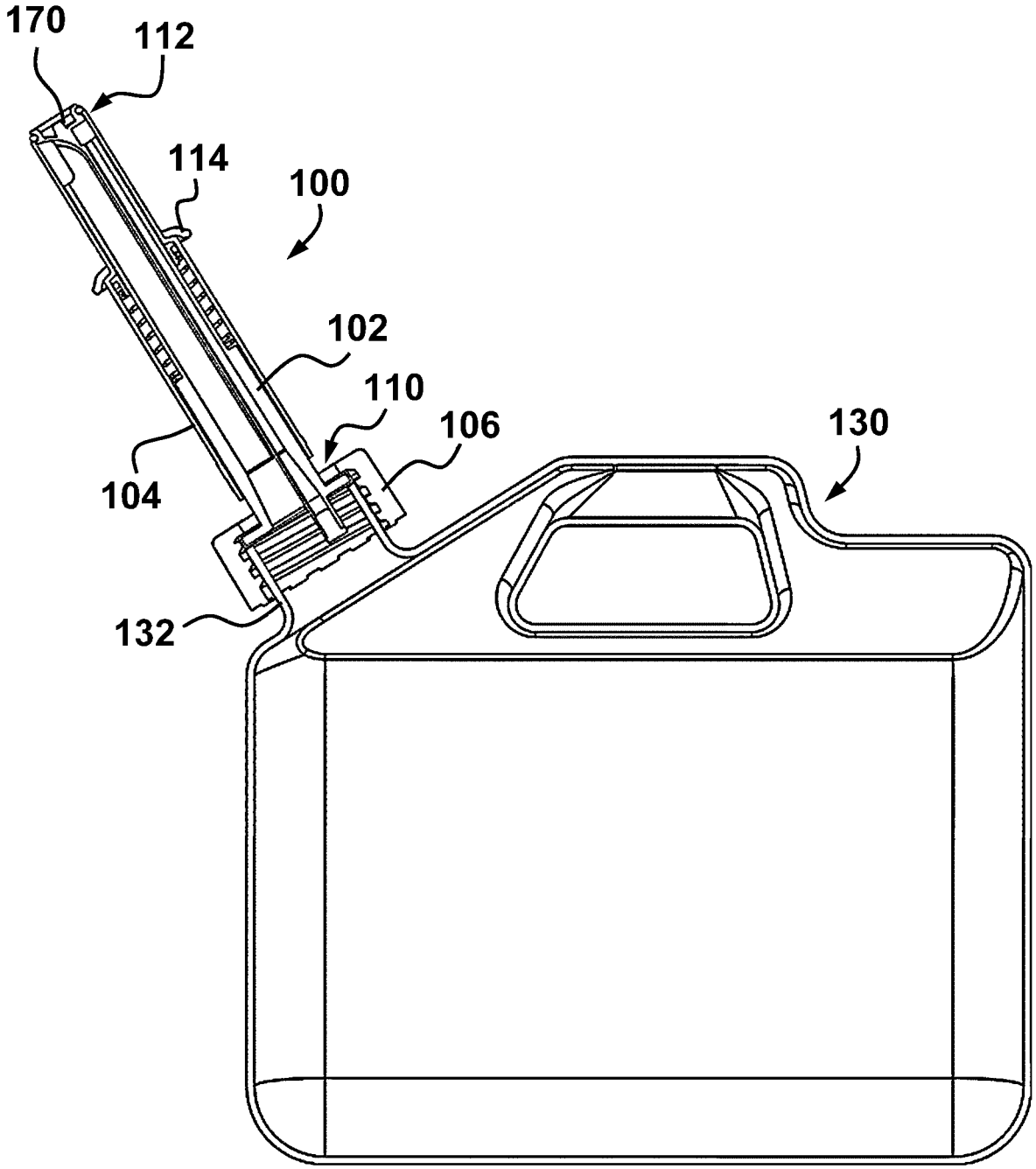
FIG. 2 is a longitudinal cross section view of the spout shown in FIG. 1 being positioned on an example of a generic liquid-storage container.

FIG. 2 is a longitudinal cross section view of the spout 100 shown in FIG. 1 being positioned on an example of a generic liquid-storage container 130. This container 130 can be, for instance, a portable container or canister designed for transporting and storing liquids. The illustrated spout 100 is well adapted for use with liquids stored in portable containers to be transferred to a receptacle at one point in time. Examples of liquids include chemical products used in industrial processes, for instance liquid ink or solvents, or liquids used in vehicles, such as washing fluids, coolant fluids and urea, to name just a few. The spout 100 can also be used with many other kinds of liquids, including non-hazardous liquids, or with volatile liquids such as gasoline, diesel or other liquid fuel products.

The container 130 illustrated in FIG. 2 is only an example for the sake of illustration. The spout 100 can be used with many other kinds of liquid-storage containers, including ones that are not portable. The containers can be rigid or nonrigid (i.e., having a relatively soft outer shell). With a rigid container, air continuously enters during pouring to compensate the volume of liquid being poured, otherwise the flow of liquid coming out of the container can eventually be severely reduced and even be interrupted. Many portable containers include an auxiliary air vent opening on a top part thereof to release built-in pressure or to admit air when pouring liquids using non-vented spouts. An auxiliary air vent opening is relatively small in size and is often closed by a corresponding threaded cap or the like. A vented spout such as the illustrated spout 100 alleviates the need of having an auxiliary air vent opening, or having to open it if one is present, since air is admitted through the spout 100 itself. Hence, any auxiliary air vent opening on a container can and should remain completely closed when pouring liquid using the vented spout 100. The spout 100 can still be used even if the auxiliary air vent opening on a given container is partially or fully opened, but the user will then forgo some of the benefits of the spout 100. For the sake of simplicity, the rest of the present description will assume that air can only enter a container, for instance the container 130, through the vented spout 100 during pouring.

Unlike a rigid container, a nonrigid container can be progressively collapsed to become more compact, at least up to certain degree, so as to compensate the volume of liquid flowing out of it. Air generally enters a nonrigid container at some point during the pouring, often through the opening by which the liquid exits. Containers made of a relatively soft material can be pressed by hand to expel the liquid more rapidly, but this may overflow the receptacle and result in a spillage, among other things. However, the spout 100 as improved can allow liquids to be poured quickly out of a nonrigid container without collapsing when the junction between the spout 100 and the opening of the receptacle can be sealed with an airtight connection during pouring.

The spout 100 can be secured to a threaded neck portion 132 of the container 130 using the collar 106, as shown in FIG. 2. The collar 106 can have internal threads matching the external threads on the neck portion 132. The collar 106 can include a central opening through which the parts beyond the spout base 110 extend. Other configurations and arrangements are possible. Among other things, at least some of these parts can be designed differently or be omitted. Other variants are possible as well.

The spout 100 of FIG. 2 is generally oriented upwards. Pouring liquid out the container 130 through the spout 100 can require, among other things, the container 130 to be tilted in a counterclockwise direction in the context of the illustration.

Figure 3:
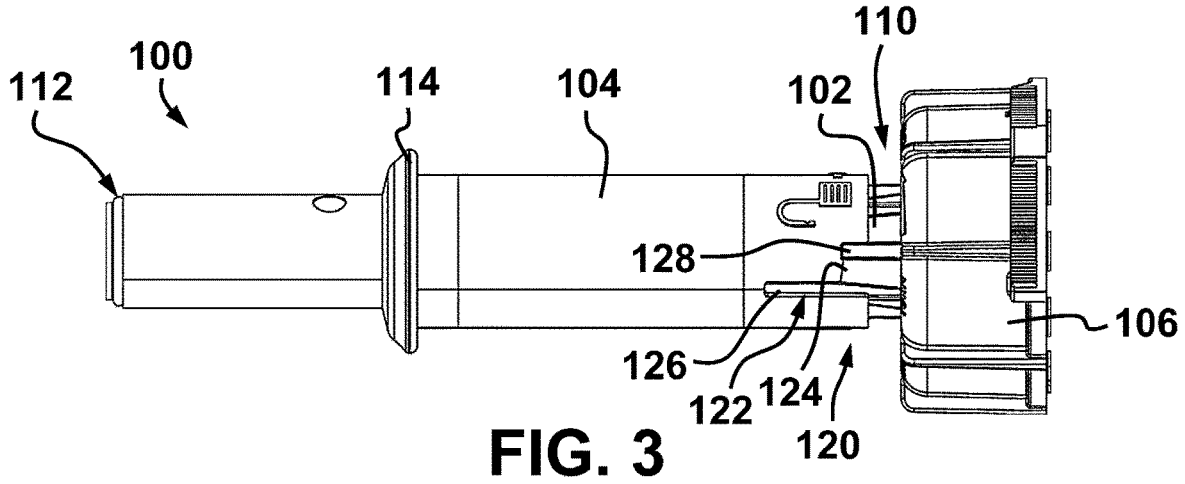
FIG. 3 is a right-side view of the spout shown in FIG. 1.
Figure 4:
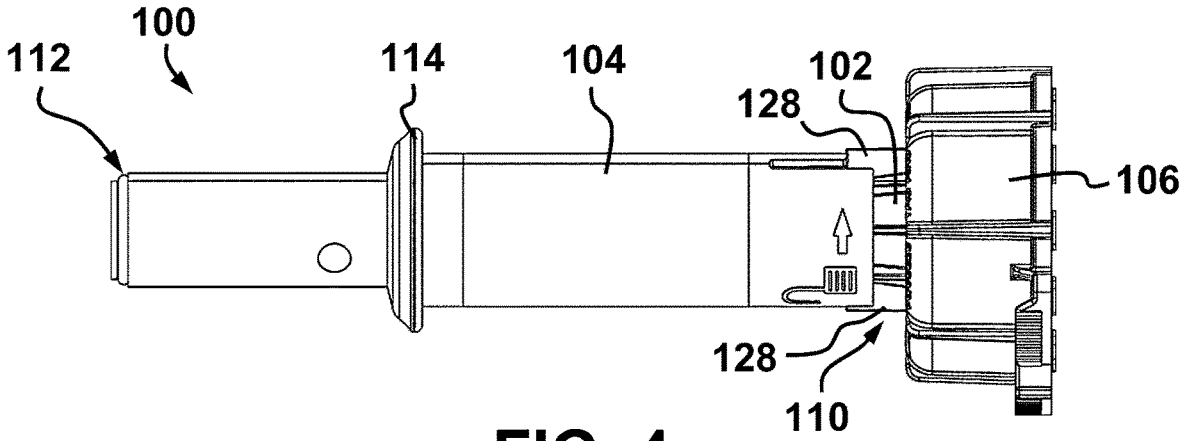
FIG. 4 is a top side view of the spout shown in FIG. 1.
Figure 5:
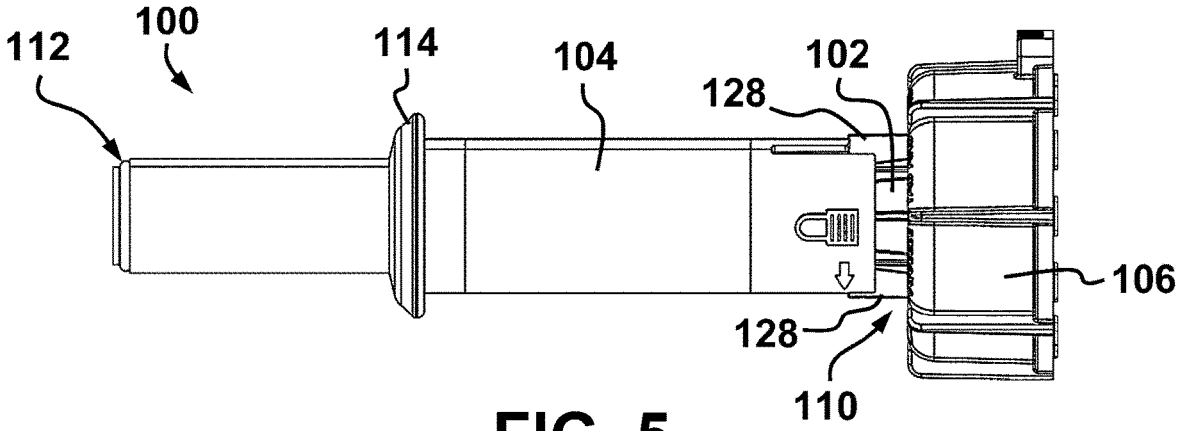
FIG. 5 is a bottom-side view of the spout shown in FIG. 1.
Figure 6:
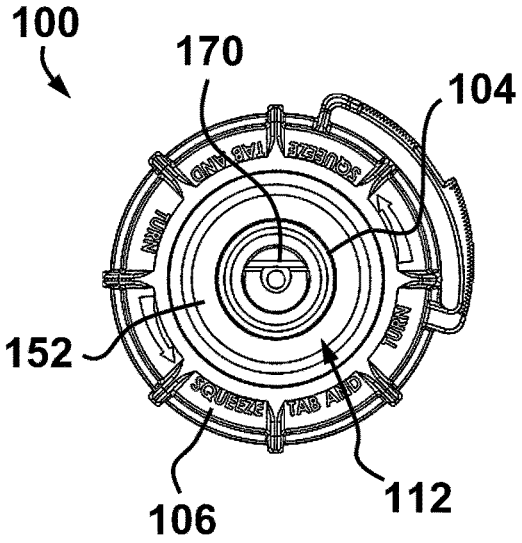
FIG. 6 is a front-end view of the spout shown in FIG. 1.
Figure 7:
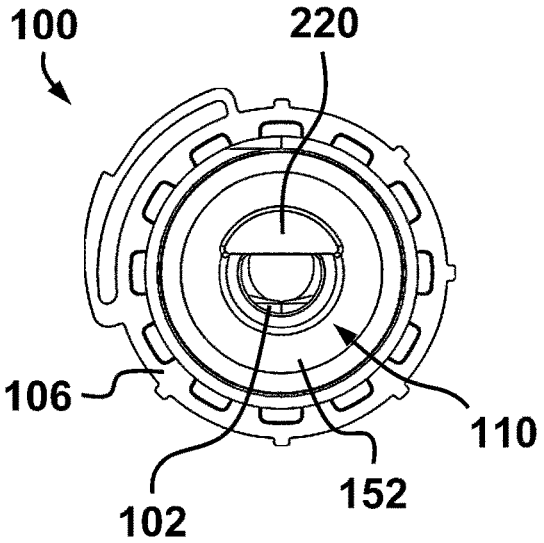
FIG. 7 is a rear-end view of the spout shown in FIG. 1.

FIGS. 3 to 5 are, respectively, a right-side view, a top side view and a bottom side view of the spout 100 shown in FIG. 1. FIGS. 6 and 7 are, respectively, a front-end view and a rear-end view of the spout 100 shown in FIG. 1.

An annular outer gasket 114 can be provided around the second member 104 at a given distance from the spout tip 112, as shown in the illustrated example. This outer gasket 114 can create an airtight connection between the spout 100 and the opening of a receptacle when liquid is poured out of the container 130 through the opening of this receptacle. The parts of the spout 100 in front of the outer gasket 114 and the interior of the receptacle in which these parts are inserted can be sealed from the surrounding outside environment, namely the space in which stands the user holding the container 130. Among other things, this airtight connection can improve the flow of liquid out of the container 130, prevent spillage of the liquid and prevent airborne droplets or vapors from spreading in the environment. Other configurations and arrangements are possible. Among other things, at least some of these parts can be designed differently or be omitted, and at least some of these features can be omitted in some implementations. Other variants are possible as well.

Figure 8:
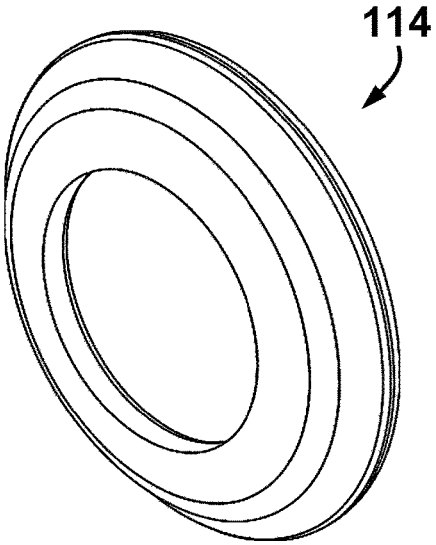
FIG. 8 is a front isometric view of the outer gasket on the spout shown in FIG. 1.
Figure 9:
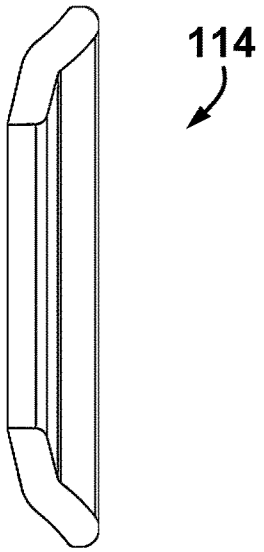
FIG. 9 is a cross-section view of the outer gasket shown in FIG. 8.

FIG. 8 is a front isometric view of the outer gasket 114 on the spout 100 shown in FIG. 1. FIG. 9 is a cross-section view thereof. As can be seen, the outer gasket 114 can have a conical shape, as shown in the illustrated example. The outer gasket 114 can be made of a resilient material, for instance a polymeric material. Other materials, configurations and arrangements are possible. Among other things, the outer gasket 114 could be replaced by another element, such as a coextruded part, or by something else. The spout 100 can be operated without using or having the outer gasket 114 and it can thus be entirely omitted in some implementations. At least some of the other parts can also be designed differently or be omitted. Other variants are possible as well.

Figure 10:
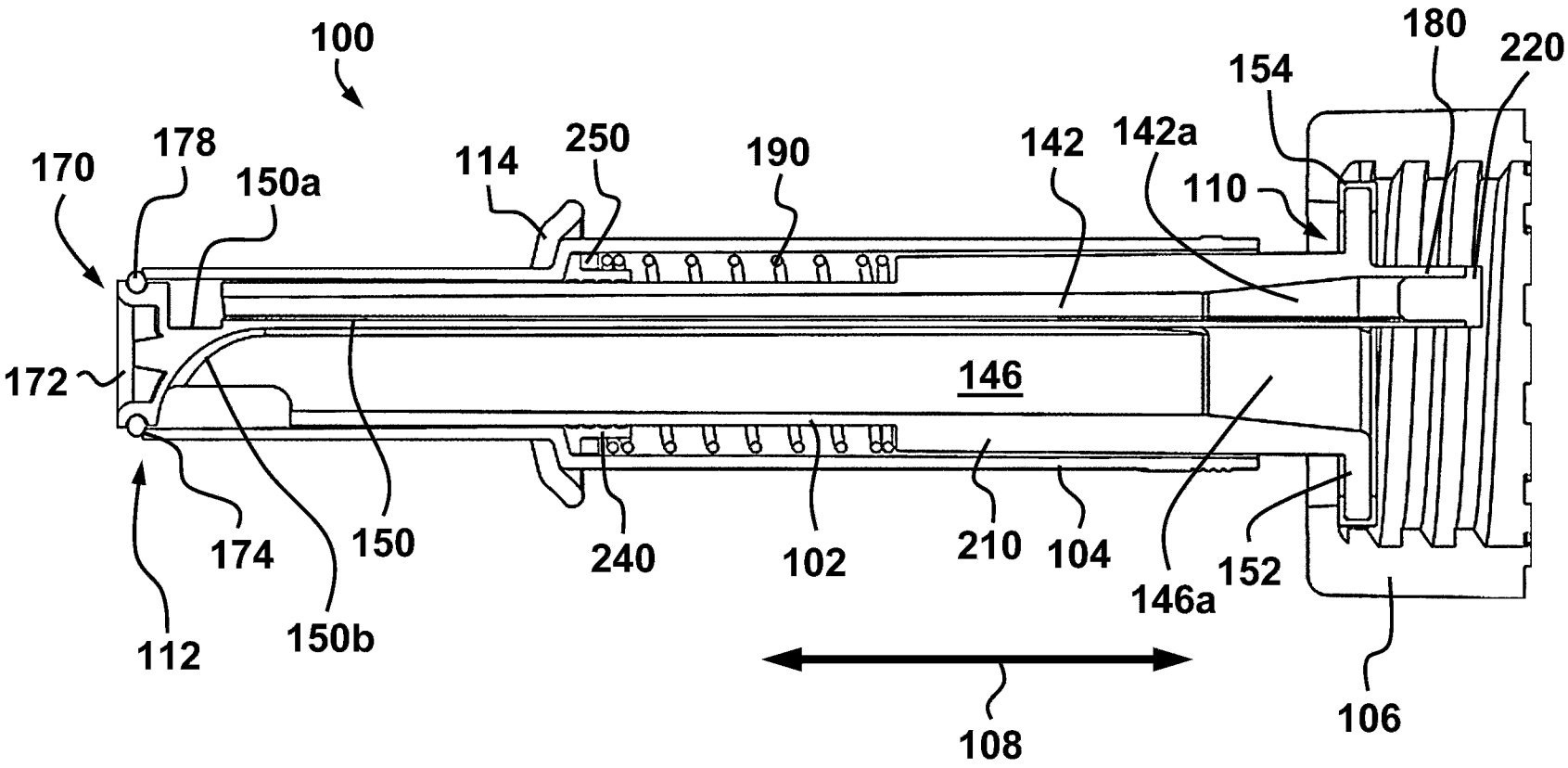
FIG. 10 an enlarged longitudinal cross section view of the spout shown in FIG. 1.
Figure 11:
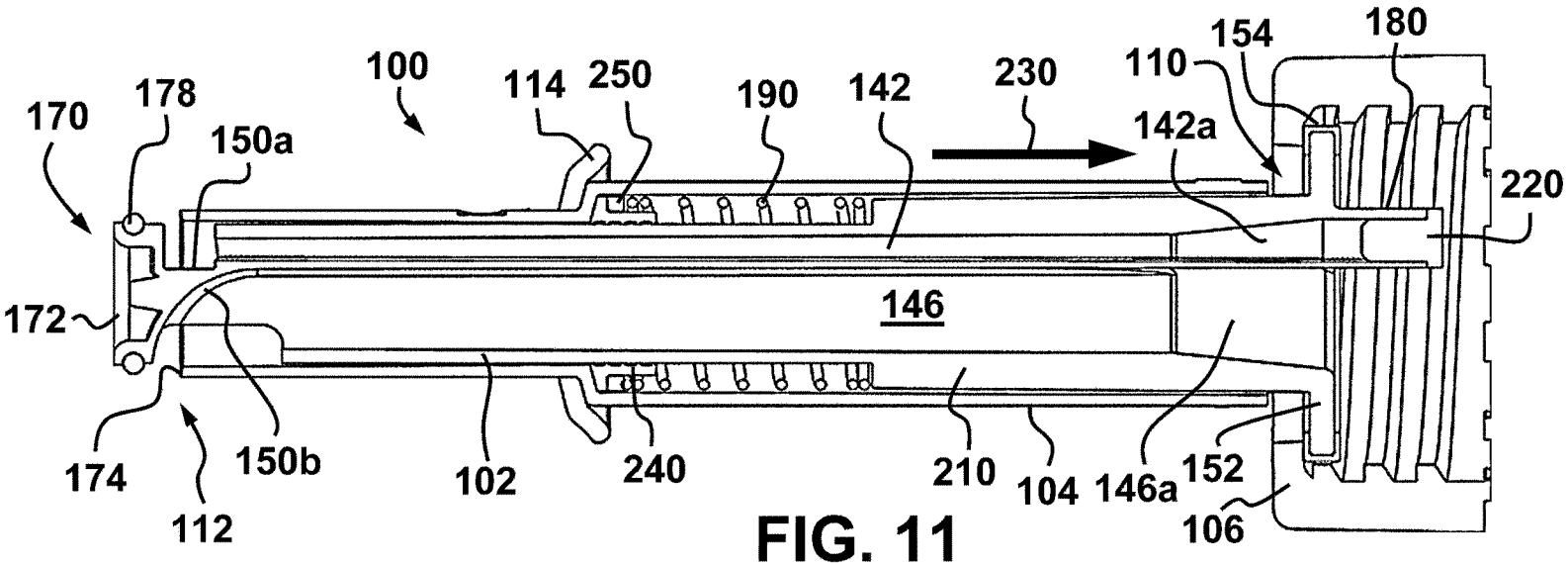
FIG. 11 is a view similar to FIG. 10 but showing the spout being in a partially opened position.
Figure 12:
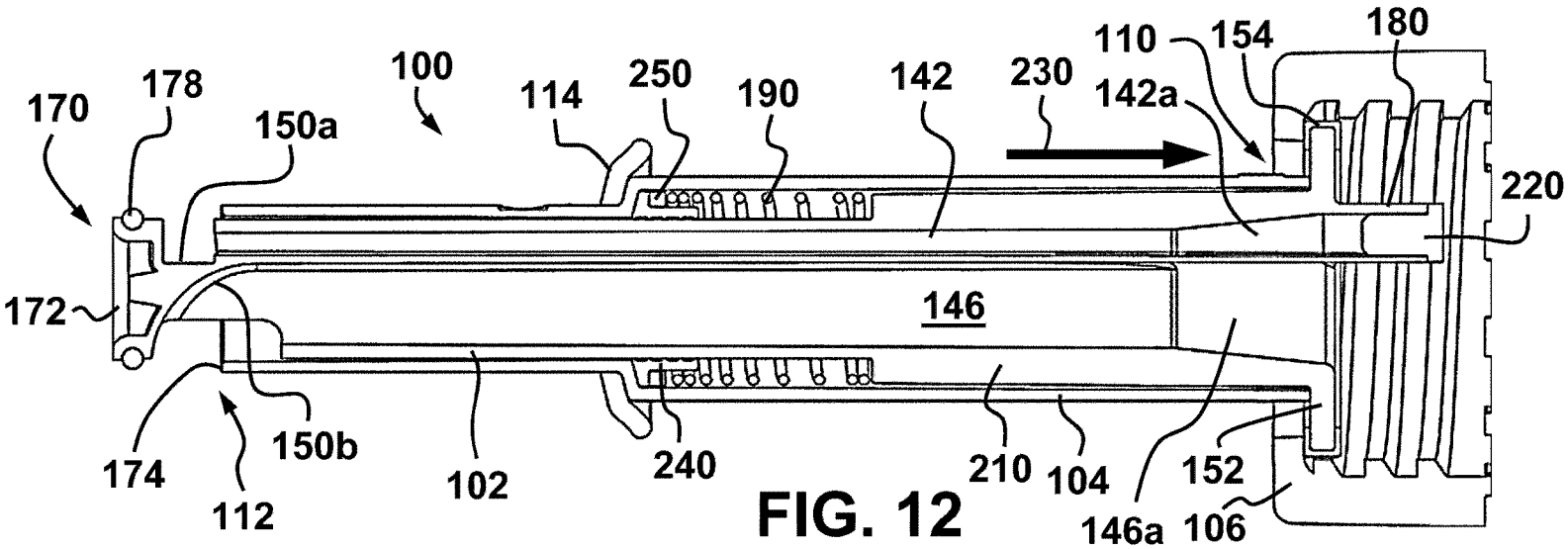
FIG. 12 is a view similar to FIG. 10 but showing the spout being in a fully opened position.

FIG. 10 is an enlarged longitudinal cross section view of the spout 100 shown in FIG. 1. This spout 100 is shown in a closed position. FIGS. 11 and 12 are views similar to FIG. 10 but showing, respectively, this spout 100 being in a partially open position and in a fully opened position.

The first member 102 can include an elongated and generally tubular first main body 140 that extends over almost the entire length of the spout 100, as shown. It can have at least two longitudinally extending internal passageways, one being an air duct 142 through which an air circuit 144 (FIG. 13) passes when air flows towards the container 130 and the other being a liquid duct 146 through which a liquid circuit 148 (FIG. 13) passes when liquid flows out of the container 130. The air duct 142 is generally positioned along a top side of the first main body 140 and is smaller in cross section than that of the liquid duct 146. The air duct 142 and the liquid duct 146 can run essentially parallel to one another, as shown, and this air duct 142 can be segregated from the liquid duct 146, i.e., be physically separated from it, along the entire length of the first main body 140 by an intervening wall 150. The intervening wall 150 extends transversally and is relatively flat along most of the air duct 142 in the illustrated example. Other configurations and arrangements are possible. Among other things, at least some of these parts can be designed differently or be omitted. Other variants are possible as well.

The liquid duct 146 can include an inlet portion **146*a* having a tapered shape, as shown in the illustrated example, this liquid duct 146 decreasing in cross section within this tapered inlet portion 146*a* and the cross-section can then remain relatively constant up to the spout tip 112. This tapered inlet portion 146*a* can be generally located at the spout base 110, as shown. The reduction in the cross section area at the inlet can be useful to ensure that the whole liquid duct 146 can be filled with liquid when pouring a large quantity of liquid out of the container 130 while the spout 100 is fully open. The force of gravity acting on the column of liquid present in the liquid duct 146 can enhance the suction effect and increase the liquid flow. Other configurations and arrangements are possible. Among other things, the tapered inlet portion 146*a*** can be designed differently or be omitted in some implementations. At least some of the other parts can also be designed differently or be omitted. Other variants are possible as well.

The spout 100 can include an enlarged outer rim portion 152, as shown in the illustrated example. The outer rim portion 152 is slightly larger in diameter than the inner diameter of the neck portion 132 of the container 130. It is made just large enough to engage the front edge of the neck portion 132 but it still fits inside the collar 106, thereby allowing the inner threads of the collar 106 to mesh with the outer threads of the neck portion 132. The rest of the spout 100 can be made smaller in width to fit through the central opening of the collar 106 and extend out of the collar 106, as shown. The interior rim around the opening of the collar 106 can engage the opposite side of the outer rim portion 152 and the collar 106 can then be tightened on the neck portion 132 until the spout 100 is solidly secured and the junction between the spout 100 and the neck portion 132 is sealed. An outer U-shaped gasket 154 can be provided around the outer rim portion 152 to enhance the sealing engagement, as shown in the illustrated example. Other configurations and arrangements are possible. Among other things, the U-shaped gasket 154 can be entirely omitted in some implementations, for instance if the material or the configuration of the parts already provides a suitable sealing engagement for the intended use. The outer rim portion 152 can be omitted as well. Some implementations can be secured to a container without using the collar 106. Other variants are possible as well.

The air duct 142 can include a portion projecting in the longitudinal direction beyond the inlet of the liquid duct 146, as shown in the illustrated example. The air duct 142 can include a downstream end 180 projecting towards the rear beyond the outer rim portion 152. Other configurations and arrangements are possible. Among other things, at least some of these parts can be designed differently or be omitted. Other variants are possible as well.

The second member 104 can include an elongated and generally tubular second main body 160 inside which the first main body 140 is slidingly movable, as shown. This second main body 160 has a front open end 162. It can also include a front section 164 and a rear section 166 (FIG. 17) that are juxtaposed to one another. These sections 164, 166 can be coaxial and the front section 164 can be shorter than the rear section 166, as shown in the illustrated example, this front section 164 being about a third of the length of the rear section 166. Other configurations and arrangements are possible. Among other things, at least some of these parts can be designed differently or be omitted. Other variants are possible as well.

The illustrated example further shows that the rear section 166 can have inner and outer diameters larger than that of the front section 164. The two sections 164, 166 can be made integral with one another and the junction between them can create an annular ridge 168 on the second main body 160, as shown. Having a larger rear section 166 can be useful for mounting other parts therein. The annular ridge 168 can also act as a stopper against which the outer gasket 114 abuts, as shown in the illustrated example. Other configurations and arrangements are possible. Among other things, the outer gasket 114 can be held in place using another arrangement or method. At least some of the parts can be designed differently or be omitted. Other variants are possible as well.

The valve of the spout 100 is generally identified at 170. This valve 170 can include a valve member 172 and the valve member 172 can engage a valve seat 174 when the spout 100 is in the normally closed position, as shown in FIG. 10. The valve member 172 is provided at the front end of the first member 102. The axial position of the valve member 172 can be shifted by changing the relative position of the second member 104 with reference to the first member 102 along the longitudinal axis 108. This can be done by pulling the second member 104 towards the collar 106 or, alternatively, by pushing the first member 102 while holding the second member 104 in position. The valve seat 174 can be a recessed part of a front open end 162 of the second main body 160. The geometric center of this valve 170 can correspond approximately to the geometric center of the second main body 160, as shown in the illustrated example, the outer diameter of this valve 170 being essentially as wide as the outer diameter of the second member 104. This can maximize the liquid flow during pouring. Other configurations and arrangements are possible. Among other things, the recessed valve seat 174 can be omitted in some implementations and the valve seat 174 can simply be the basic flat end surface surrounding the front open end 162, for instance. The valve seat 174 can be offset with reference to the geometric center of the second main body 160 in some implementations. At least some of the other parts can be designed differently or be omitted. Other variants are possible as well.

The valve member 172 can include an outer circumferential groove 176 to receive a valve gasket 178, for instance an O-ring or the like. This valve member 172 can then engage the valve seat 174 through the valve gasket 178, as shown. Other configurations and arrangements are possible. Among other things, the valve gasket 178 can also be entirely omitted in some implementations, for instance if the material and the configuration of the parts already provide a suitable sealing engagement for the intended use. At least some of the other parts can be designed differently or be omitted. Other variants are possible as well.

The valve gasket 178 can hold the first and second members 102, 104 together, as shown in the illustrated example. Removing this valve gasket 178 from its outer circumferential groove 176 can allow the first member 102 to be pulled out the second member 104 from the rear end thereof. Other configurations and arrangements are possible. Among other things, this feature can be omitted in some implementations. Other variants are possible as well.

As shown in the illustrated example, the spout 100 can include a biasing element 190 provided to urge the valve member 172, thus the spout 100, towards a normally closed position when no actuating force is applied by a user or when such force is released. This biasing element 190 can be a compression helical spring concealed inside the spout 100, as shown. It can counterbalance an actuating force 230 applied by the user when this valve member 172 is open. Other configurations and arrangements are possible. Among other things, other kinds of biasing elements are possible, and the biasing element can be positioned differently on the spout 100, including being outside the spout 100. At least some of the other parts can also be designed differently or be omitted. Other variants are possible as well.

FIGS. 11 and 12 show, among other things, that the biasing element 190 of the illustrated spout 100 can be progressively compressed when the valve member 172 moves away from the valve seat 174. The biasing element 190 could even become fully compressed or almost fully compressed at the fully opened position in some implementations. Other configurations and arrangements are possible.

In use, some air can enter the container 130 through the air circuit 144 during pouring to replace a proportional volume of liquid flowing out of the container 130. Air stops entering the container 130 when the flow of outgoing liquid stops. However, interrupting the incoming airflow can significantly reduce and even stop the liquid flow shortly thereafter if a negative pressure, relative to the ambient air pressure, increases beyond a certain point inside the container 130. The negative pressure built up can start when the spout tip 112 is submerged into the liquid inside the receptacle 200 during the pouring of liquid from the container 130. A negative pressure is what causes the air to enter the container 130 but if no more air enters, the negative pressure can prevent liquid from flowing out. Now, since the tip 112 of the illustrated spout 100 is where both the liquid outlet and the air inlet are located, the flow of liquid through the spout 100 can automatically decrease and can even stop soon after the spout tip 112 is immersed inside the liquid. The user can then release the actuating force 230 on the container 130 that keeps the valve 170 open. The biasing element 190 can move the second member 104 forward with reference to the first member 102 and close the valve 170. Some liquid can still be present in the liquid duct 146 and even in the air duct 142 at this instant. However, since the valve 170 is located at the spout tip 112, the liquid will be kept within the spout 100 and will flow into the container 130 once it is tilted back to the upstanding position shown in FIG. 2. Other configurations and arrangements are possible. Among other things, at least some of the parts can be designed differently or be omitted, and at least some of the features can be omitted in some implementations. Other variants are possible as well.

Figure 13:
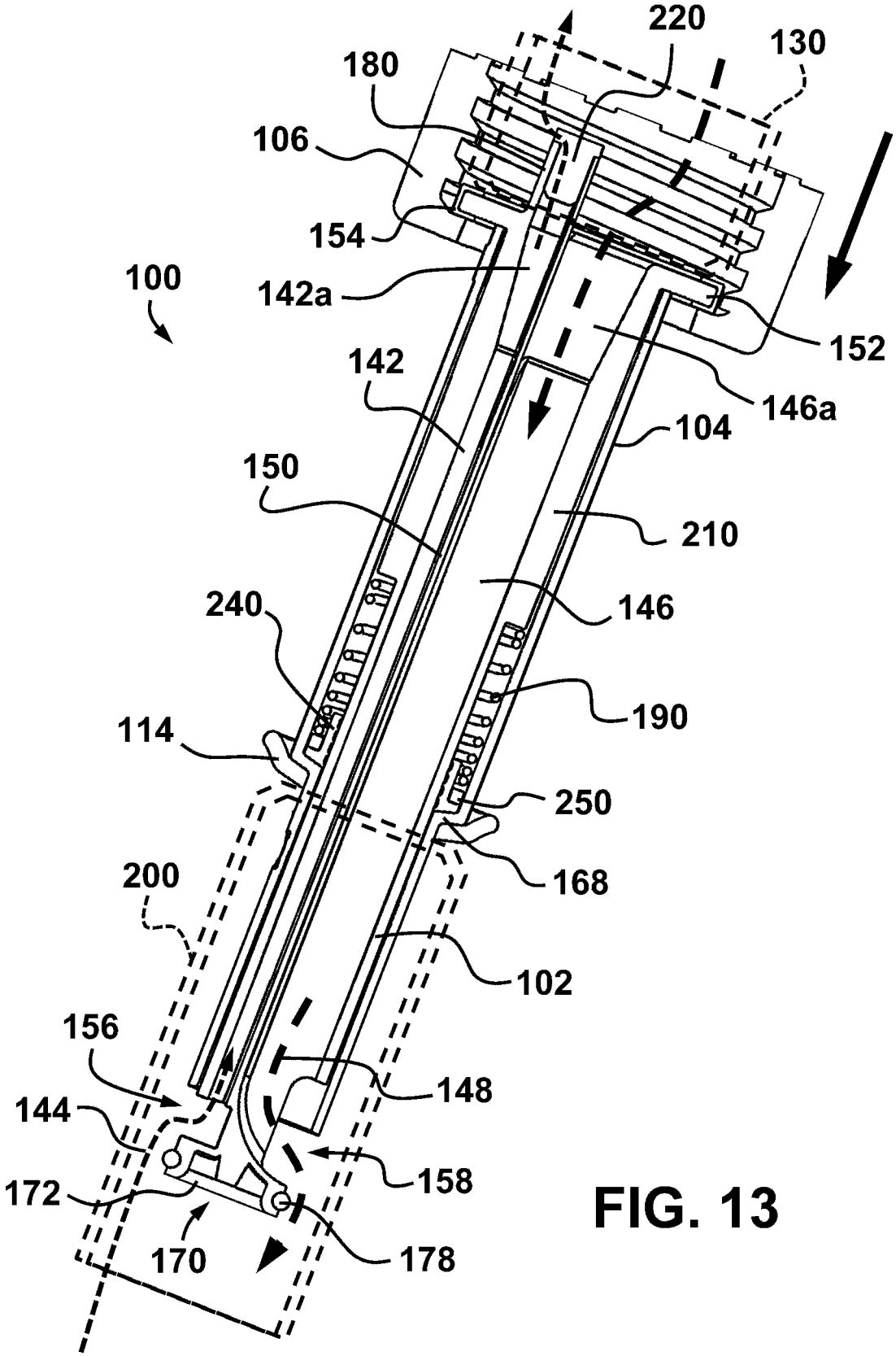
FIG. 13 is a semi-schematic view of the spout shown in FIG. 12 when transferring the liquid from the liquid-storage container into a receptacle.

FIG. 13 is a semi-schematic view of the spout 100 shown in FIG. 12 when transferring the liquid from the liquid-storage container 130 into a receptacle 200. The liquid-storage container 130 and the receptacle 200 are schematically depicted in FIG. 13. The spout 100 is shown being pressed against an inlet opening of the receptacle 200 and the container 130 is located above. The front part of the spout 100 can be inserted into the inlet opening of the receptacle 200 up to the outer gasket 114, this outer gasket 114 being larger than the inlet opening. An airtight sealing engagement can be created and maintained by the user pressing down on the container 130 with an actuating force 230 so as to urge the outer gasket 114 against the rim of the opening of the receptacle 200. The actuating force 230 exerted by the user can also maintain the spout 100 opened when the first member 102 is pushed forward with reference to the second member 104. Other configurations and arrangements are possible. Among other things, at least some of these parts can be designed differently or be omitted. Other variants are possible as well.

The spout 100 can be designed so that the air required for filling the container 130 can only come from the receptacle 200 because of the airtight connection, as shown in FIG. 13. Since air is expelled out of the receptacle 200 to compensate the volume of the incoming liquid and that air is required inside the container 130 to compensate the volume of the outgoing liquid, air can simply be transferred from one to the other and there can be no need to draw air from outside. The flow can then be constant, efficient and optimum. Among other things, air pushed out of the receptacle 200 by incoming liquid can be forced to exit only through the air duct 142 when the junction between the spout 100 and the receptacle 200 is entirety sealed. The pressure created can then facilitate the air admission into the container 130 through the air duct 142, and airborne droplets or vapors present around the spout tip 112 during pouring can be drawn into the container 130 with the incoming air, thereby significantly minimizing the exposure of the user to these droplets or vapors. The supply of air through the spout 100 into the container 130 can greatly improve the liquid flow and can prevent the container 130, if this is a nonrigid one, from collapsing. Other configurations and arrangements are possible. Among other things, at least some of these parts can be designed differently or be omitted. Other variants are possible as well.

Some receptacles 200 or implementations may not allow a sealing engagement to be created between the spout 100 and the opening of the receptacle 200. Nevertheless, if the spout tip 112 is located within the opening or very close to it during pouring, most of the air entering the container 130 can originate from within the receptacle 200. Airborne droplets or vapors can be drawn into the container 130 as well. Still, the flow of liquid can automatically slow down and even stop once the spout tip 112 is below the liquid level, even if there is no sealing engagement. Other configurations and arrangements are possible.

Figure 14:
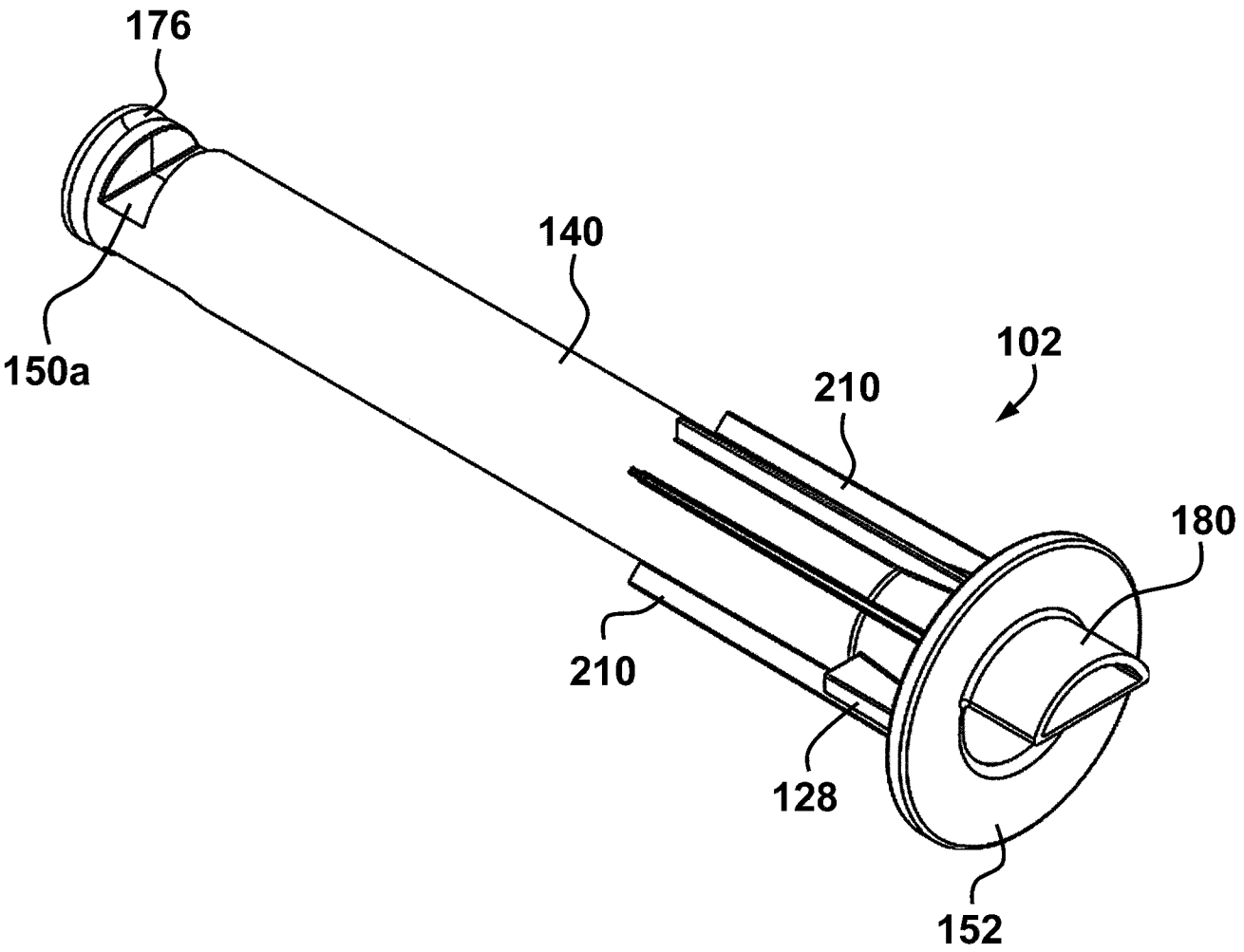
FIG. 14 is a rear isometric view of the first member of the spout shown in FIG. 1.
Figure 15:
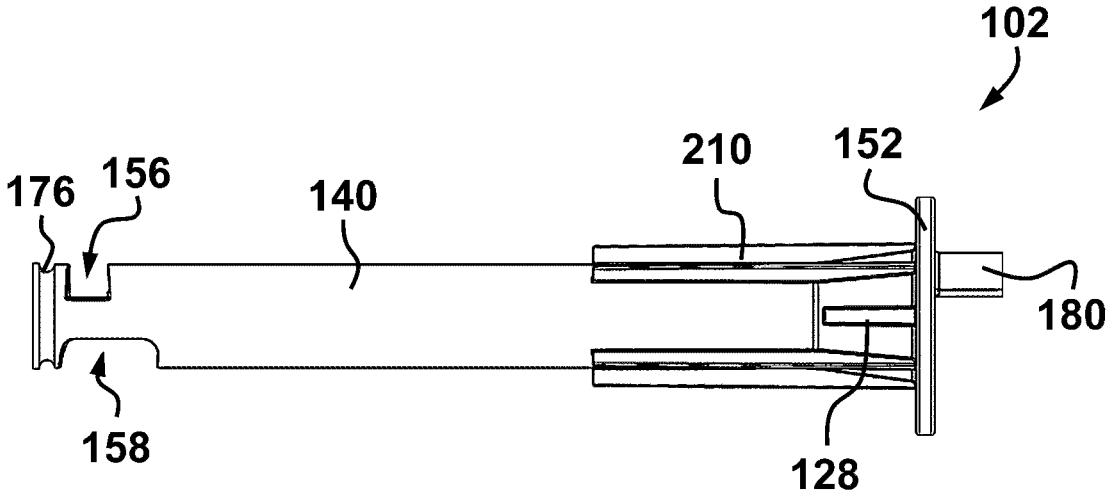
FIG. 15 is a right-side view of the first member shown in FIG. 14.
Figure 16:
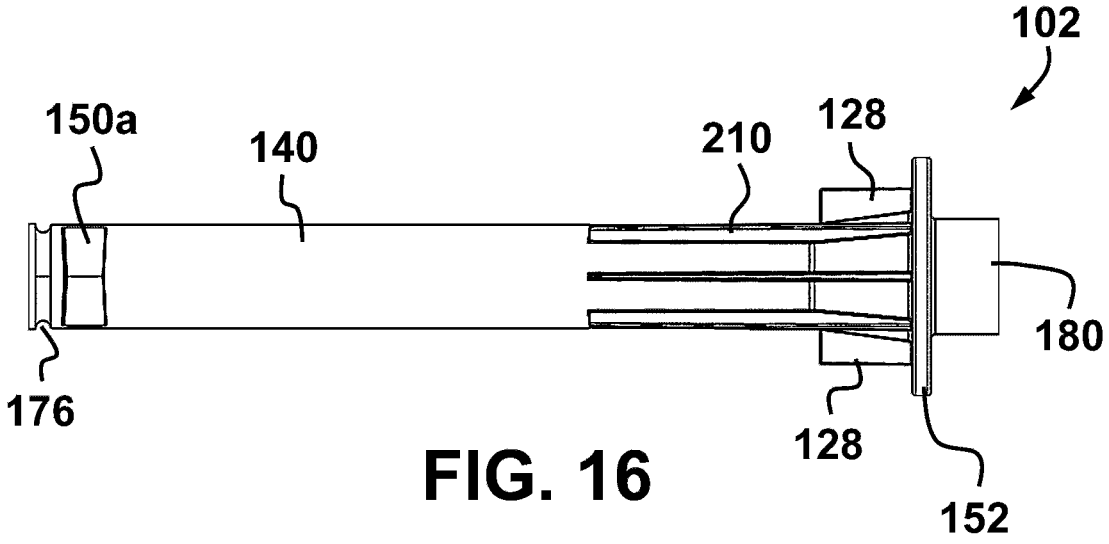
FIG. 16 is a top view of the first member shown in FIG. 14.

FIGS. 14 to 16 are, respectively, a rear isometric view, a right-side view and a top view of the first member 102 in the spout 100 shown in FIG. 1. As can be seen, the first member 102 can include a plurality of spaced apart radially projecting longitudinal ribs 210, as shown in the illustrated example. There are six longitudinal ribs 210 in this example and these longitudinal ribs 210 are projecting from the outer surface of the first member 102 to guide it within the rear section 166 of the second main body 160, the interior of the second main body 160 being larger than the exterior of the first main body 140 in this part of the spout 100. The top edges of these longitudinal ribs 210 can be rectilinear and be in a sliding engagement with the interior of the rear section 166, as shown. These longitudinal ribs 210 can keep the first member 102 centered with reference to the second member 104. Their presence can also improve the structural rigidity of the first member 102. Nevertheless, other configurations and arrangements are possible. Among other things, the number of longitudinal ribs 210, their relative position, or even both, can be different. The longitudinal ribs 210 can be replaced by other features or be entirely omitted in some implementations. At least some of the other parts can also be designed differently or be omitted. Other variants are possible as well.

The front end of the first member 102 of the spout 100 can include a top air inlet opening 156 and a bottom liquid outlet opening 158, both made through the first main body 140, as shown in the illustrated example. The top air inlet opening 156 can be smaller in length than that of the bottom liquid outlet opening 158, as shown. Both openings 156, 158 can be separated by a front section of the intervening wall 150 and the top side 150*a* of this front section can be flat. The front section can also include a bottom side 150*b* that is curved, with a relatively large radius of curvature, so as to redirect the liquid in a substantially radially outward direction as it leaves the liquid duct 146 inside the first member 102, as shown. This curved bottom side 150*b* can mitigate splashes and the creation of airborne droplets since the liquid can be prevented from abruptly impinging on a surface at the back of the valve member 172. Other configurations and arrangements are possible. Among other things, at least some of these parts can be designed differently or be omitted. Other variants are possible as well.

Figure 17:
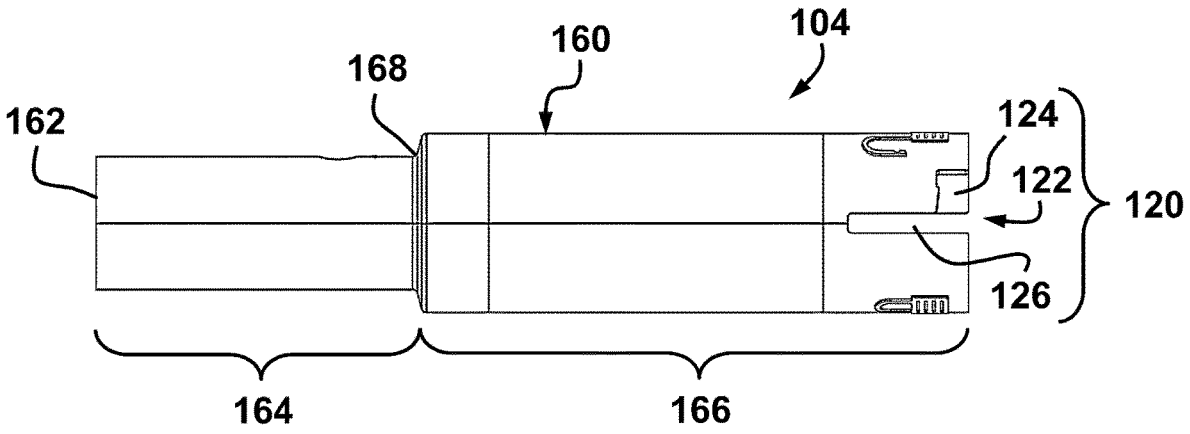
FIG. 17 is a side view of the second member of the spout shown in FIG. 1.
Figure 18:
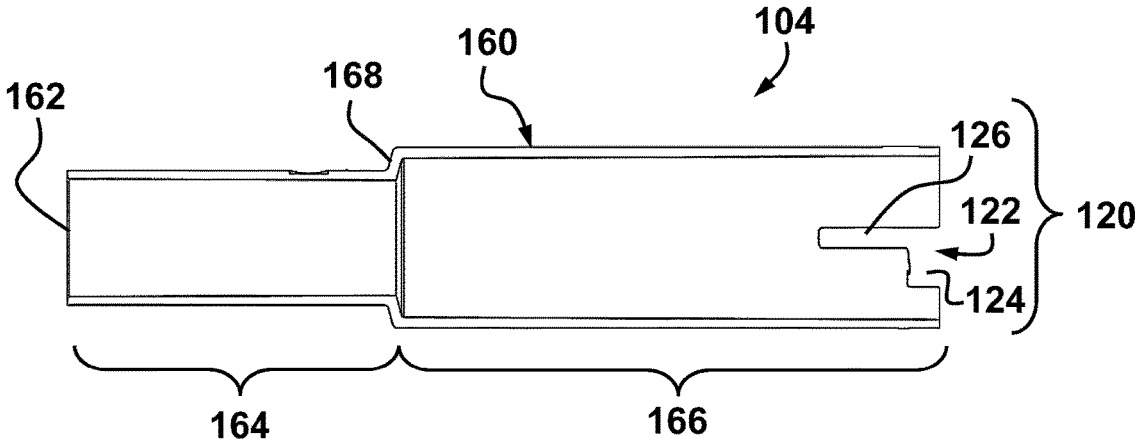
FIG. 18 is a longitudinal cross section view of the second member shown in FIG. 17.

FIG. 17 is a side view of the second member 104 in the spout 100 shown in FIG. 1. FIG. 18 is a longitudinal cross section view thereof.

As aforesaid, the spout 100 can include a locking arrangement, for instance a locking system 120, as shown in the illustrated example. This locking system 120 can be designed essentially to provide a basic safety measure and is not necessarily a child-resistant closure. It can include a pair of substantially L-shaped openings 122 at the rear end of the second member 104. These openings 122 can be diametrically opposite to one another, as shown. Each opening 122 can include two adjacent sections 124, 126 that are distinct in length, the first section 124 being shorter than the second section 126. These openings 122 can cooperate with corresponding radially extending tabs 128 (see FIGS. 14 to 16) projecting out of the first member 102 next to the outer rim portion 152, as shown in the illustrated example. These two opposite tabs 128 are adjacent to the longitudinal ribs 210. However, they are radially taller, longitudinally shorter and larger in width compared to the longitudinal ribs 210. The second member 104 can be pivoted with reference to the first member 102 over a few degrees, just enough to change the relative angular position between them, thereby moving the tabs 128 between the sections 124, 126. The pivot motion can be made by the user in both directions and the biasing element 190 in the illustrated example is not designed to generate torque. The angular position is thus only selected by the user in this implementation. When the tabs 128 of the illustrated example are positioned in the first section 124, no space is available to slide the first member 102 with reference to the second member 104 and the spout 100 is then in a locked position. However, when the tabs 128 are in the second section 126, there can be enough space to slide the first member 102 with reference to the second member 104 and the spout 100 is then in an unlocked position. Other configurations and arrangements are possible. Among other things, a locking system can be implemented using only one opening 122 and one corresponding tab 128. At least some of the other parts can also be designed differently or be omitted. The locking system 120 can be entirely omitted. Other variants are possible as well.

Figure 19:
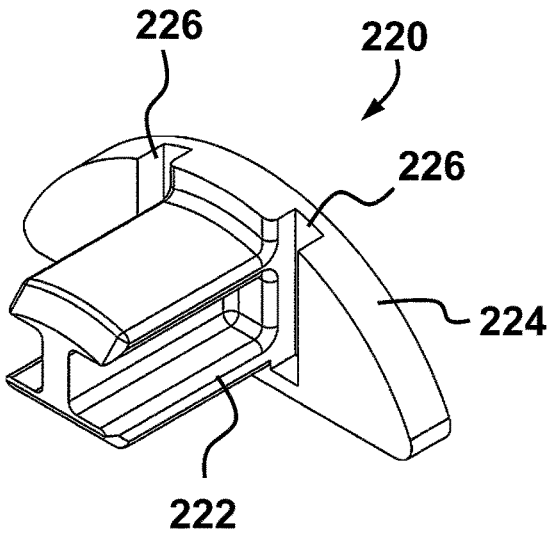
FIG. 19 is a front isometric view of the plug forming constricted openings in the spout shown in FIG. 1.

FIG. 19 is a front isometric view of the plug 220 forming constricted openings in the spout 100 shown in FIG. 1. The plug 220 is a part that can be added at the downstream end 180 of the air duct 142 during manufacturing. During pouring, this arrangement can accelerate the airflow before air enters the liquid and form bubbles inside the liquid of the container 130. The accelerated airflow, among other things, can prevent the liquid from entering the air duct 142 at the beginning of the pouring. Keeping liquids out of the air duct 142 can greatly improve the initial airflow and the liquid can start flowing out of the spout 100 very fast after opening the valve 170. Nevertheless, other configurations and arrangements are possible. For instance, although the plug 220 can lower the manufacturing costs and reduce the complexity of manufacturing the spout 100, one or more constricted openings can be molded directly at the downstream end 180 of the air duct 142. Some implementations may not require having a constricted opening and the downstream end 180 could remain wide open. At least some of the other parts can also be designed differently or be omitted. Other variants are possible as well.

The plug 220 can have a substantially T-shaped configuration, as shown in FIG. 19. It can include an elongated upstream portion 222 and a larger transversal downstream portion 224. The upstream portion 222 can be designed to fit inside the downstream end 180 of the air duct 142. It can be attached by an interference fit or by any other suitable method. The rear edge of the downstream portion 224 can abut against the front edge at the downstream end 180 of the air duct 142 and cover the entire area thereof. The downstream portion 224 can leave only two small spaced-apart openings 226 at the top through which the incoming air can exit the air duct 142. Other configurations and arrangements are possible. Among other things, the plug 220 can have only one opening 226 or more than two openings 226 in some implementations. At least some of the other parts can also be designed differently or be omitted. Other variants are possible as well.

The air duct 142 can include an end portion 142*a* that has a tapered shape, as shown in the illustrated example. This tapered end portion 142*a* is generally located at the spout base 110. The increase in the cross section area can create a larger chamber immediately upstream the plug 220 in which air pressure can increase before passing through the openings 226. Other configurations and arrangements are possible. Among other things, the tapered end portion 142*a* can be omitted in some implementations. At least some of the other parts can also be designed differently or be omitted. Other variants are possible as well.

Figure 20:
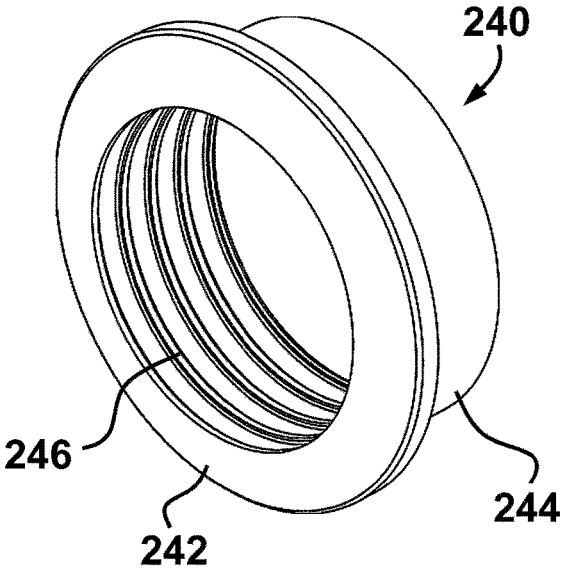
FIG. 20 is a front isometric view of the inner gasket in the spout shown in FIG. 1.

FIG. 20 is a front isometric view of the inner gasket 240 in the spout 100 shown in FIG. 1. This inner gasket 240 can be provided between the first member 102 and the second member 104 to seal in an airtight manner an intervening peripheral space between the first main body 140 and the second main body 160, as shown. The inner gasket 240 can be useful to prevent air from entering the air duct 142 when the receptacle into which the liquid is transferred is full and the spout tip 112 is immersed into the liquid. A negative relative pressure can be created inside the container 130 if air can no longer enter the spout tip 112 and the inner gasket 240 can prevent outside air from entering the air duct 142 through the small peripheral space between the first main body 140 and the second main body 160 when this occurs. The inner gasket 240 can include an elongated cylindrical body 242 having an enlarged annular flanged portion 244 at one end to engage the interior of the annular ridge 168, as shown in the illustrated example (see for instance in FIG. 13). The interior of this inner gasket body 242 can include a plurality of small spaced-apart annular ribs 246. The inner gasket 240 can be made, for instance, of a polymeric material. Other materials, configurations and arrangements are possible. Among other things, the inner gasket 240 can be omitted in some implementations. At least some of the other parts can also be designed differently or be omitted. Other variants are possible as well.

Figure 21:
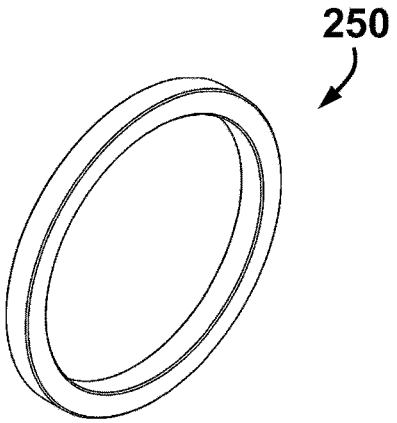
FIG. 21 is an isometric view of the intervening ring provided between the inner gasket and the biasing element in the spout shown in FIG. 1.

FIG. 21 is an isometric view of the intervening ring 250 provided between the inner gasket 240 and the biasing element 190 in the spout 100 shown in FIG. 1. The ring 250 used in the illustrated example is essentially a spacer keeping the inner gasket 240 in place and providing a surface against which one end of the biasing element 190, in this case the helical spring positioned around the first member 102, is engaged. The ring 250 can be made of a rigid plastic material or any other suitable material. The opposite end of the biasing element 190 can engage the front end of one or more of the longitudinal ribs 210, as shown in the illustrated example. These parts, namely the biasing element 190, the longitudinal ribs 210, the inner gasket 240 and the ring 250, can be located in the larger intervening peripheral space between the exterior of the first main body 140 and the interior of the rear section 166 of the second main body 160, as shown. Other materials, configurations and arrangements are possible. Among other things, the ring 250 can be omitted in some implementations. At least some of the other parts can also be designed differently or be omitted. Other variants are possible as well.

Figure 22:
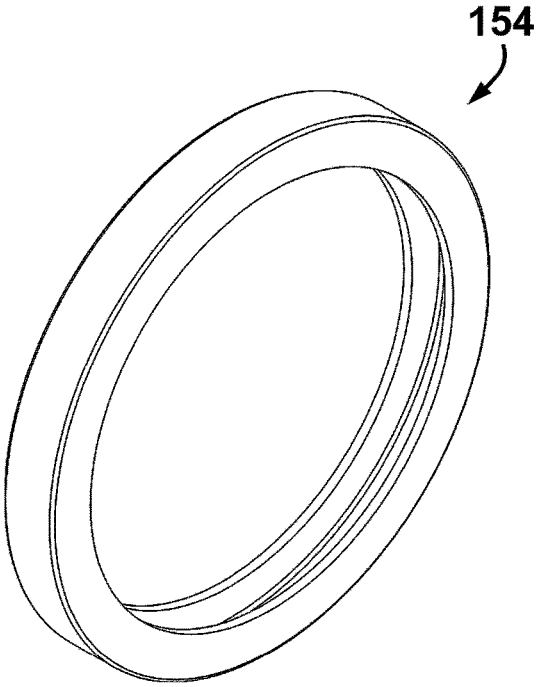
FIG. 22 is an isometric view of the outer U-shaped gasket provided on the enlarged outer rim portion on the spout shown in FIG. 1.

FIG. 22 is an isometric view of the U-shaped gasket 154 provided around the enlarged outer rim portion 152 on the spout 100 shown in FIG. 1. Other configurations and arrangements are possible. Among other things, the U-shaped gasket 154 can be omitted in some implementations. Other variants are possible as well.

Figure 23:
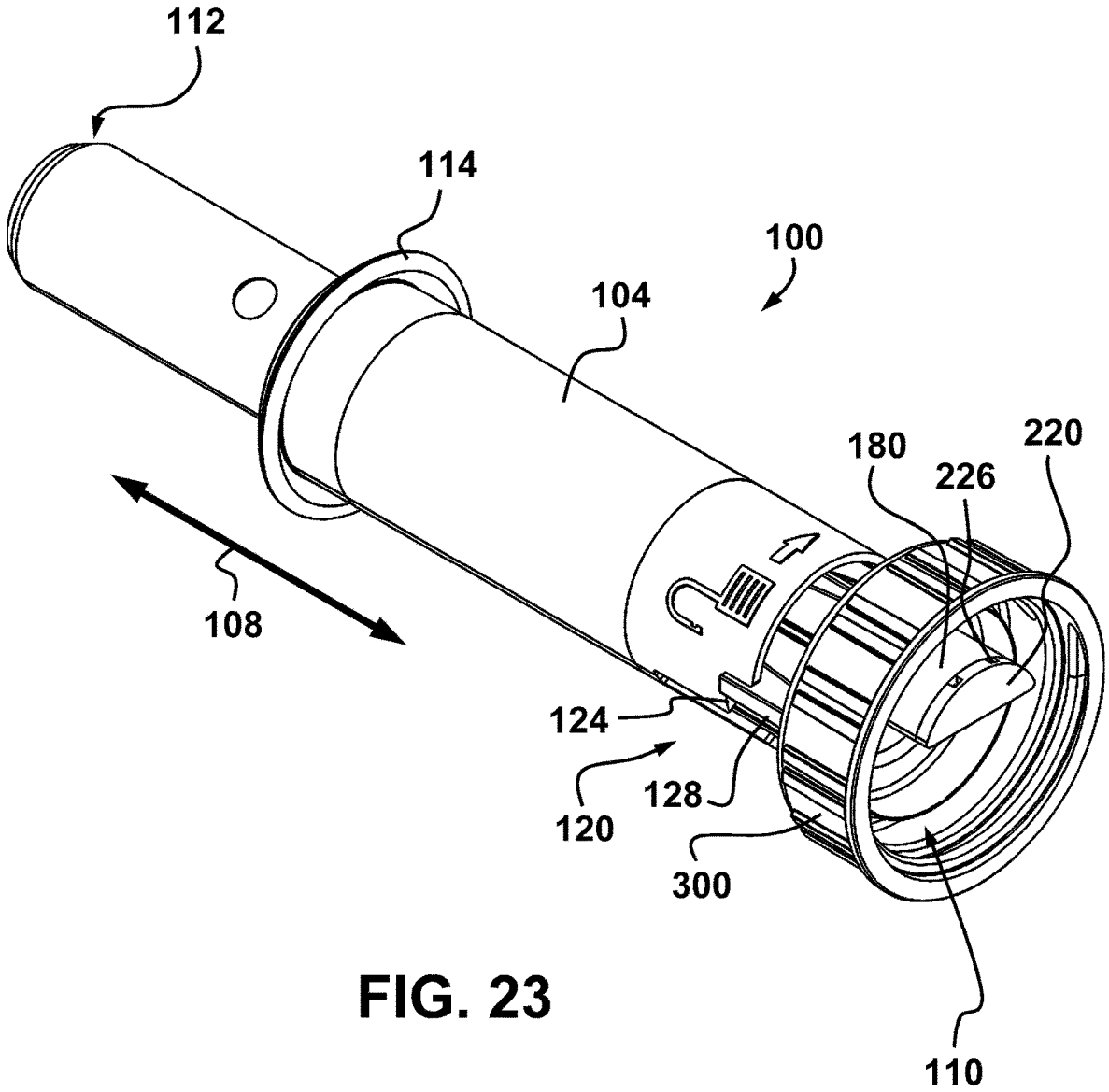
FIG. 23 is a rear isometric view of another example of a spout as improved.
Figure 24:
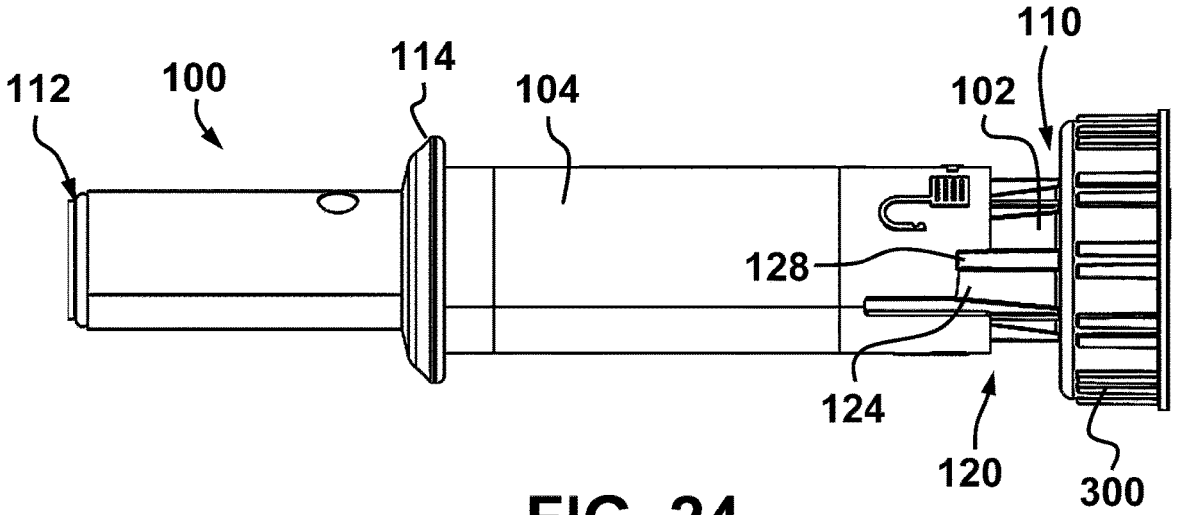
FIG. 24 is a right-side view of the spout shown in FIG. 23.

FIG. 23 is a rear isometric view of another example of a spout 100 as improved. FIG. 24 is a right-side view of the spout 100 shown in FIG. 23. The spout 100 illustrated in FIGS. 23 and 24 also includes a locking system 120. These figures show the spout 100 being in a locked position. This spout 100 is relatively similar to the example shown in FIG. 1 but it includes a built-in threaded cap 300 instead of the enlarged outer rim portion 152. This threaded cap 300 can be made integral with the first member 102, as shown in this illustrated example. The other parts of this spout 100 are similar or identical to the ones already described and illustrated. Other configurations and arrangements are possible. Among other things, the spout 100 of FIGS. 23 and 24 can be secured directly on a container, such as the container 130 of FIG. 2, without using the collar 106. It could also fit on ajar or a bottle if the threads match. At least some of the parts can be designed differently or be omitted. Other variants are possible as well.

Figure 25:
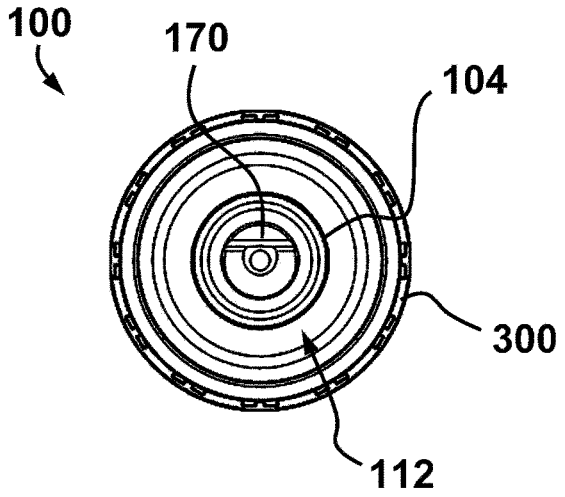
FIG. 25 is a front-end view of the spout shown in FIG. 23.
Figure 26:
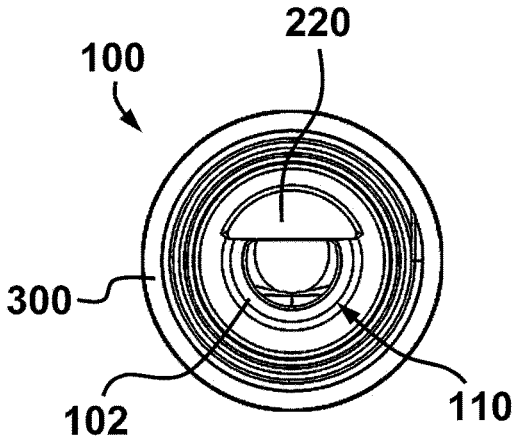
FIG. 26 is a rear-end view of the spout shown in FIG. 23.
Figure 27:
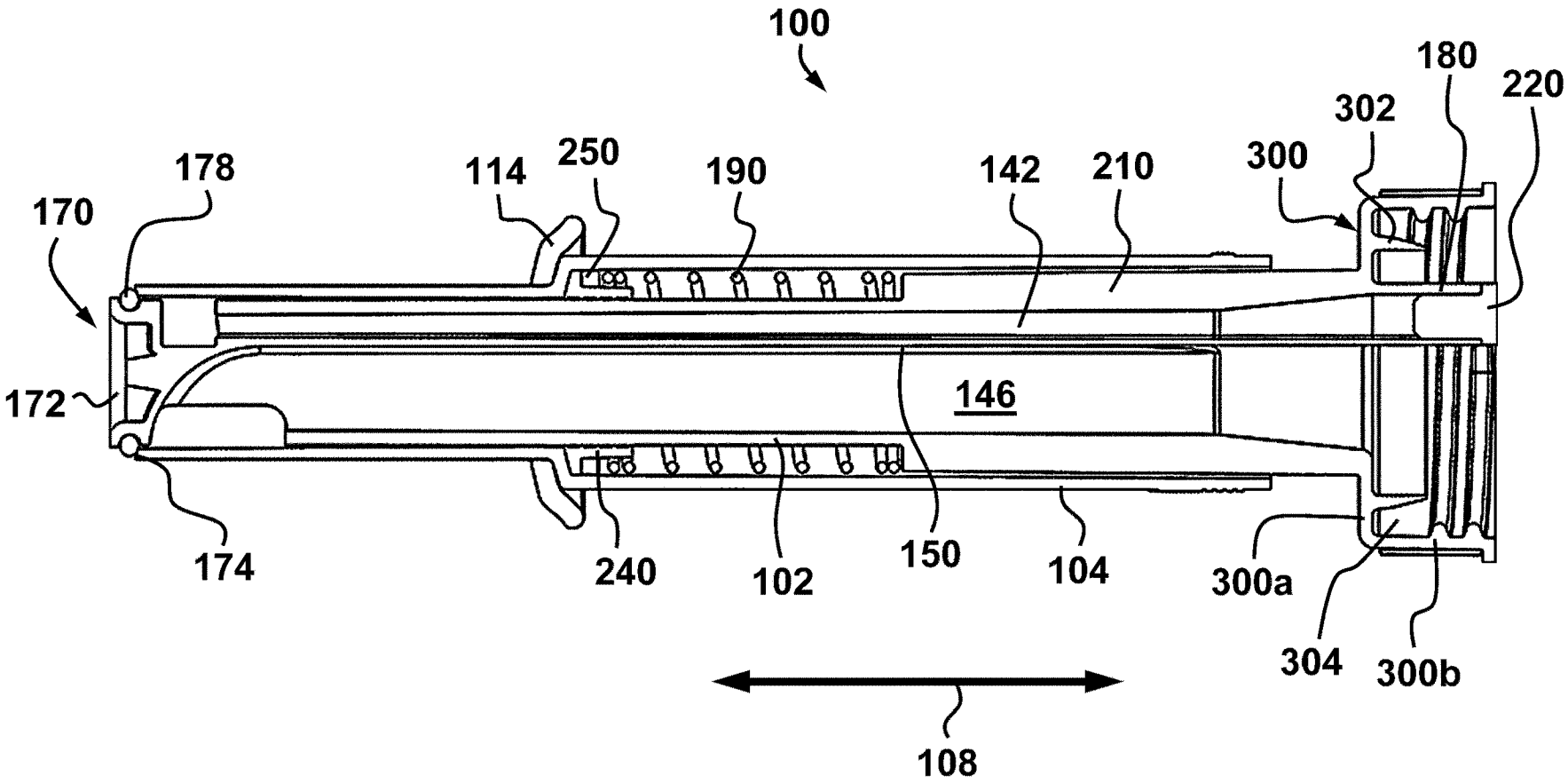
FIG. 27 is an enlarged longitudinal cross section view of the spout shown in FIG. 23.
Figure 28:
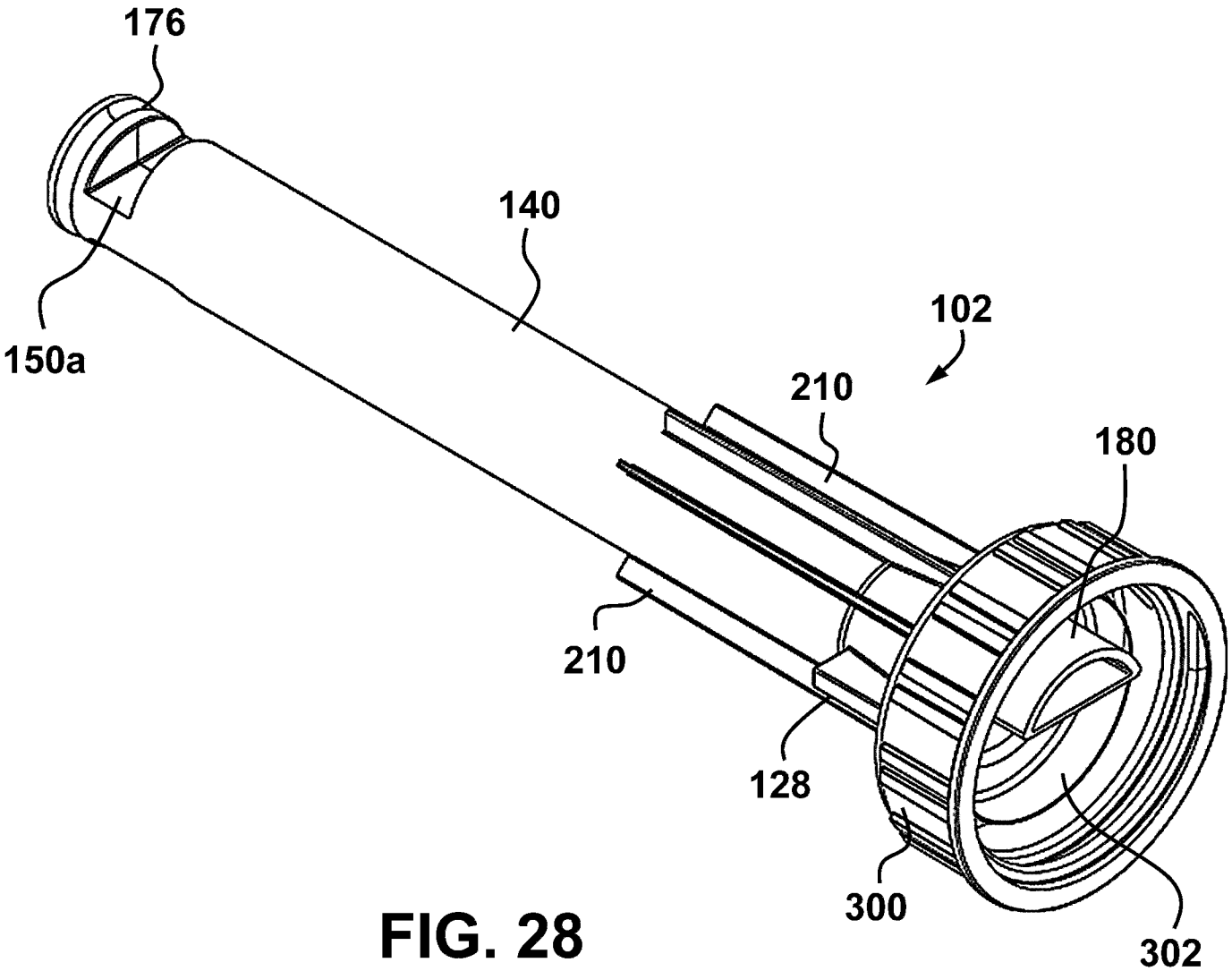
FIG. 28 is a rear isometric view of the first member of the spout shown in FIG. 23.

FIGS. 25 and 26 are, respectively, a front-end view and a rear-end view of the spout 100 shown in FIG. 23. FIG. 27 is an enlarged longitudinal cross section view of the spout 100 shown in FIG. 23. FIG. 28 is a rear isometric view of the first member 102 in the spout 100 shown in FIG. 23. As can be seen, the spout 100 can include a rearwardly projecting annular flange 302 extending from a radially extending portion 300*a* of the threaded cap 300 and surrounding both the air duct 142 and the liquid duct 146. This annular flange 302 can create an annular space 304 delimited by the exterior of the annular flange 302 as well as the interior of the radially extending portion 300*a* and the interior of a longitudinally extending portion 300*b* of the threaded cap 300, as shown. This annular space 304 can receive, for instance, the front edge section of the neck portion 132 of the container 130. The annular space 304 can be designed so that the front edge section of this neck portion 132 fits tightly therein so as to seal the junction without using a gasket. This can simplify manufacturing and lower costs. Other configurations and arrangements are possible. Among other things, at least some of these parts can be designed differently or be omitted. Other variants are possible as well.

Overall, the spout 100 as proposed herein can have, among other things, one or more the following advantages:

- the spout 100 can be used with rigid or nonrigid containers;

when used with a nonrigid container, the spout 100 can allow the container to be emptied very efficiently without collapsing when the junction between the opening of the receptacle and the spout 100 can be made airtight;

the flow can automatically be decreased and then stopped when the spout tip 112 is immersed in the liquid of the receptacle 200;

the spout 100 can be designed to minimize the creation of airborne droplets during pouring;

airborne droplets or vapors present around the spout tip 112 during pouring can be drawn into the container 130 with the incoming air, thereby preventing or at least minimizing the presence of droplets or vapors in the surrounding environment;

the liquid output can be maximized because the flow restrictions can be minimized;

the liquid duct 146 can be entirely filled with liquid during pouring at the fully opened position and the force of gravity acting on the column of liquid therein can improve the suction effect, thereby further increasing the flow;

the initial response time can be very fast, and the liquid can start flowing fast almost immediately after opening the spout 100;

the number of parts required for manufacturing the spout 100 can be minimized, thereby lowering costs;

the parts of the spout 100 can be manufactured at a relatively low cost.

The present detailed description and the appended figures are meant to be exemplary only, and a skilled person will recognize that variants can be made in light of a review of the present disclosure without departing from the proposed concept. Among other things, and unless otherwise explicitly specified, none of the parts, elements, characteristics or features, or any combination thereof, should be interpreted as being necessarily essential to the invention simply because of their presence in one or more examples described, shown and/or suggested herein.

LIST OF REFERENCE NUMERALS

100 spout
102 first member
104 second member
106 collar
108 longitudinal axis
110 spout base
112 spout tip
114 outer gasket
120 locking system
122 opening (of locking system)
124 first section (of opening 122)
126 second section (of opening 122)
128 tab (of locking system)
130 liquid-storage container
132 neck portion (of the liquid-storage container)
140 first main body
142 air duct
142*a* end portion (of air duct)
144 air circuit
146 liquid duct
146*a* inlet portion (of liquid duct)
148 liquid circuit
150 intervening wall
150*a* top side (of front section of the intervening wall)
150*b* bottom side (of front section of the intervening wall)
152 outer rim portion
154 gasket
156 top air inlet opening
158 bottom liquid outlet opening
160 second main body
162 front open end (of the second main body)
164 front section (of the second main body)
166 rear section (of the second main body)
168 ridge
170 valve
172 valve member
174 valve seat
176 valve groove
178 valve gasket
180 downstream end (of air duct)
190 biasing element
200 receptacle
210 rib (on the first member)
220 plug
222 upstream portion (of the plug)
224 downstream portion (of the plug)
226 opening (on the plug)
230 actuating force
240 inner gasket
242 body (of inner gasket)
244 flanged portion
246 rib (inside the inner gasket body)
250 intervening ring
300 threaded cap
300*a* radially extending portion (of threaded cap)
300*b* longitudinally extending portion (of threaded cap)
302 annular flange
304 annular space

What is claimed is:

1. A vented pouring spout for a liquid-storage container, the spout comprising a first member including a first main body, a second member including a second main body inside which the first main body is slidingly movable from a closed position of the spout out into an open position of the spout for transferring liquid from the container, and a shutoff valve system at the front end of the first member at the tip of the spout, wherein:

the first main body comprises an air duct with an air inlet opening for air flow to the container from the front end of the first member at the tip of the spout and an air outlet opening to the container at a base of the spout; a liquid duct with a liquid inlet opening for liquid flow out of the container at a liquid outlet of the container at the spout at the base of the spout and a liquid outlet opening for the liquid flow from the container out at a liquid output of the spout at the tip of the spout;

the liquid inlet opening at the base of the spout for the liquid flow out of the container is larger than the liquid outlet opening for output of the liquid at the tip of spout;

the shutoff valve system controlling air ingress into the container to compensate a volume of liquid being poured out of the container using the spout secured at the liquid outlet of the container; and wherein the liquid output of the spout comprises a curved bottom side.

2. The spout as defined in claim 1, wherein the second member comprises an annular outer gasket, the outer gasket being positioned at a given distance from the tip of the spout to create an airtight connection between the spout and an opening of a receptacle when liquid is poured out of the container to the receptacle through the opening of the receptacle.

3. The spout as defined in claim 2, wherein the outer gasket has a conical shape.

4. The spout as defined in claim 2, wherein the spout comprises a biasing element positioned between the first member and the second member to urge the spout towards the closed position.

5. The spout as defined in claim 1, wherein the spout includes an inner gasket provided between the first member and the second member to seal in an airtight manner a front peripheral space between the first member and the second member, the inner gasket including an elongated cylindrical body having an enlarged annular flanged portion at one end to engage an interior portion of the second member.

6. The spout as defined in claim 1, wherein the spout comprises at least one of:

the first member includes a threaded cap adjacent to the base of the spout; and the first member and the second member are substantially rectilinear.

7. The spout as defined in claim 1, wherein the air duct includes a downstream end projecting longitudinally beyond the liquid inlet opening the downstream end is closed by a plug inserted therein, the plug including at least one constricted opening located at a top of the plug through which the air circuit exits the air duct.

8. The spout as defined in claim 1, wherein the spout includes at least one of:

the liquid duct includes a tapered inlet portion, the liquid duct decreasing in cross section within the tapered inlet portion; and the air duct includes a tapered end portion immediately adjacent to a downstream end of the air duct, the air duct increasing in cross section within the tapered end portion.

9. The spout as defined in claim 1, wherein the spout includes a locking system, the locking system including at least one opening made at a rear-end of the second member and having two adjacent sections that are distinct in length, the sections being selectively engaged by a corresponding tab, radially projecting from the first member, when changing a relative angular position between the first and second members, one of the sections corresponding to a locked position and another to an unlocked position.

10. The spout as defined in claim 1, wherein the air inlet opening is located on top of the tip of the spout and the liquid outlet opening is located on the bottom of the tip of the spout, air entering the spout through the top air inlet opening and liquid exiting the spout through the bottom liquid outlet opening when the spout is in the opened position, the top air inlet opening being smaller in length than the bottom liquid outlet opening.

11. A vented pouring spout for a liquid-storage container, the spout comprising:

a first member including a first main body comprising an air duct through which an air circuit passes when air enters the container and a liquid duct through which a liquid circuit passes when liquid flows out of the container, the air duct being generally positioned along a top side of the first member and being smaller in cross section than the liquid duct, the air duct being segregated from the liquid duct along a length of the first member by a wall;

a valve at a front end of the first member;

a second member including a second main body inside which the first main body is slidingly axially movable, the second member having a front section and a rear section, the front section having a front open end defining a valve seat that is engaged by the valve when the spout is in a normally closed position to interrupt the air circuit and the liquid circuit, the valve being out of engagement with the valve seat when the spout is in a fully opened position; and a biasing element positioned between the first member and the second member to urge the spout towards the normally closed position;

wherein:

the first member comprises a liquid inlet opening at a base of the spout for a liquid flow out of the container, and a liquid outlet opening for output of the liquid flow at a tip of spout, the liquid inlet opening being larger than the liquid outlet opening; the liquid outlet opening is located on a bottom side of the first member at the tip of the spout; the first member comprises an air inlet opening located at the top side of the first member; air entering the spout through the air inlet opening and liquid exiting the spout through the liquid outlet opening when the spout is in the fully opened position.

12. The spout as defined in claim 11, wherein the spout includes an annular outer gasket provided around the second member, the outer gasket being positioned at a given distance from the tip of the spout to create an airtight connection between the spout and an opening of a receptacle when liquid is poured out of the container to the receptacle through the opening of the receptacle.

13. The spout as defined in claim 12, wherein the spout includes at least one of the following features:

the outer gasket has a conical shape;

the rear section of the second member has an inner diameter larger than an inner diameter of the front section and an outer diameter larger than an outer diameter of the front section, the outer gasket abutting against a stopper located on the second member, the stopper being an annular ridge created at a junction between the front section and the rear section of the second member.

14. The spout as defined in claim 11, wherein the spout includes at least one of:

the rear section of the second member has an inner diameter larger than an inner diameter of the front section and an outer diameter larger than an outer diameter of the front section; the biasing element is located in an annular space between the first member and the rear section of the second member;

the first member includes a plurality of spaced apart radially projecting longitudinal ribs, the first member being in a sliding engagement with an inner side of the rear section of the second member through the longitudinal ribs, and the biasing element engaging a front end of the longitudinal ribs;

the first member includes an enlarged outer rim portion adjacent to the base of the spout; and the first member includes an enlarged outer rim portion adjacent to the base of the spout, the outer rim portion including an outer U-shaped gasket.

15. The spout as defined in claim 11, wherein the spout includes an inner gasket provided between the first member and the second member to seal in an airtight manner a front peripheral space between the first member and the second member, the inner gasket including an elongated cylindrical body having an enlarged annular flanged portion at one end to engage an interior portion of the second member.

16. The spout as defined in claim 11, wherein the spout includes at least one of the following features:

the biasing element includes a compression helical spring;

the first member includes a threaded cap adjacent to the base of the spout;

the first member and the second member are substantially rectilinear; and the valve member has an outer circumferential groove, the valve including a valve gasket positioned in the outer circumferential groove.

17. The spout as defined in claim 11, wherein the air duct includes a downstream end projecting longitudinally beyond the liquid outlet opening, the spout further including one of:

the downstream end is closed by a plug inserted therein, the plug including at least one constricted opening located at a top of the plug through which the air circuit exits the air duct; and the downstream end is closed by a plug inserted therein, the plug including at least one constricted opening located at a top of the plug through which the air circuit exits the air duct, the plug having a substantially T-shaped configuration and including an elongated upstream portion and a transversal downstream portion, the upstream portion being designed to fit inside the downstream end of the air duct.

18. The spout as defined in claim 11, wherein the spout includes at least one of:

the air duct includes a tapered end portion immediately adjacent to a downstream end of the air duct, the air duct increasing in cross section within the tapered end portion; and the liquid duct includes a tapered inlet portion, the liquid duct decreasing in cross section within the tapered inlet portion.

19. The spout as defined in claim 11, wherein the spout includes a locking system, the locking system including at least one opening made at a rear-end of the second member and having two adjacent sections that are distinct in length, the sections being selectively engaged by a corresponding tab, radially projecting from the first member, when changing a relative angular position between the first and second members, one of the sections corresponding to a locked position and another to an unlocked position.

20. The spout as defined in claim 1, wherein the air duct for air flow to the container through the air opening at the base of the spout is larger than the air inlet opening at the tip of the spout for ingress of air into the container.

* * * * *